US009150033B2

(12) United States Patent
Kondo et al.

(10) Patent No.: US 9,150,033 B2
(45) Date of Patent: Oct. 6, 2015

(54) PRINTING APPARATUS AND PRINTING METHOD

(71) Applicant: SEIKO EPSON CORPORATION, Tokyo (JP)

(72) Inventors: Takamitsu Kondo, Nagano (JP); Hiroshi Wada, Nagano (JP); Toru Takahashi, Nagano (JP); Kazuyoshi Tanase, Nagano (JP); Satoru Miura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 200 days.

(21) Appl. No.: 13/858,499

(22) Filed: Apr. 8, 2013

(65) Prior Publication Data

US 2013/0286085 A1 Oct. 31, 2013

(30) Foreign Application Priority Data

Apr. 27, 2012 (JP) ..... 2012-103514

(51) Int. Cl.
*B41J 2/01* (2006.01)
*B41J 11/00* (2006.01)

(52) U.S. Cl.
CPC ..... *B41J 11/002* (2013.01)

(58) Field of Classification Search
CPC ..... B41J 11/002
USPC ..... 347/102
See application file for complete search history.

(56) References Cited

U.S. PATENT DOCUMENTS 6,477,948 B1 * 11/2002 Nissing et al. ..... 101/211
2005/0190248 A1 * 9/2005 Konno et al. ..... 347/102
2007/0040885 A1 * 2/2007 Kusunoki ..... 347/102
2007/0058021 A1 * 3/2007 Kusunoki ..... 347/102
2008/0174650 A1 * 7/2008 Nakazawa et al. ..... 347/102
2008/0225101 A1 9/2008 Kumagai
2008/0238998 A1 * 10/2008 Nakazawa et al. ..... 347/42
2008/0239043 A1 * 10/2008 Nakazawa ..... 347/102
2010/0201771 A1 * 8/2010 Mitsuzawa ..... 347/102
2010/0201772 A1 8/2010 Mitsuzawa
2010/0271449 A1 * 10/2010 Kusunoki ..... 347/102
2011/0001783 A1 1/2011 Fujisawa
2011/0020562 A1 * 1/2011 Fujisawa ..... 427/487
2011/0085013 A1 4/2011 Onishi et al.
2012/0069082 A1 3/2012 Hayata

FOREIGN PATENT DOCUMENTS

JP 2008-265285 A 11/2008

OTHER PUBLICATIONS

The extended European Search Report for European Application No. 13162309.2 mailed Aug. 22, 2013.

* cited by examiner

*Primary Examiner* — Matthew Luu
*Assistant Examiner* — Patrick King
(74) *Attorney, Agent, or Firm* — Global IP Counselors, LLP

(57) ABSTRACT

There is provided a printing apparatus including: a transport unit which transports a medium in a transport direction, a first head, a first light source which is provided further to the downstream side in the transport direction than the first head, a second head which is provided further to the downstream side in the transport direction than the first head and the first light source, and a second light source which is provided further to the downstream side in the transport direction than the second head and which irradiates light with a stronger irradiation energy than the irradiation energy of the first light source, in which the first head ejects ink of one color of any among magenta ink, cyan ink, and black ink onto a medium, and the second head ejects yellow ink onto the medium.

10 Claims, 17 Drawing Sheets

FIRST EMBODIMENT

FIRST EMBODIMENT

COMPARATIVE EXAMPLE

SECOND EMBODIMENT

THIRD EMBODIMENT

SURFACE PRINTING PRINTED IMAGE

REVERSE PRINTING PRINTED IMAGE

FOURTH EMBODIMENT

FIFTH EMBODIMENT

FIFTH EMBODIMENT

FIG. 11A

| | IRRADIATION ENERGY NECESSARY FOR MAIN CURING ($mJ/cm^2$) |
|---|---|
| COLOR INK (CMYK) | 500 (=Pc) |
| CLEAR INK (CL) | 280 (=Pcl) |

$Pcl < Pc$

FIG. 11B

| | IRRADIATION INTENSITY ($mW/cm^2$) | IRRADIATION ENERGY ($mJ/cm^2$) |
|---|---|---|
| PRE-CURING (M, C, K) | 1200 | 20 (=P0) |
| STRONG PRE-CURING (Y) | 1200 | 200 (=P1) |
| MAIN CURING | 1200 | 300 (=P2) |

$P1 < Pc \leq P1 + P2$
$Pcl < P2 < Pc$

FIG. 13A

| ITEM | COMPONENT NAME | C | | M | | Y | | | | | | | | | K | | W | CL |
|---|---|---|---|---|---|---|---|---|---|---|---|---|---|---|---|---|---|---|
| PIGMENT DISPERSION | CYAN | 2.2 | 2.2 | | | | | | | | | | | | | | | |
| | MAGENTA | | | 4.0 | 4.0 | | | | | | | | | | | | | |
| | YELLOW-1 | | | | | 3.1 | | | | 2.1 | 1.6 | | 2.1 | 2.1 | | | | |
| | YELLOW-2 | | | | | | 3.1 | | | 1.0 | | 1.0 | 0.5 | 0.5 | | | | |
| | YELLOW-3 | | | | | | | 3.1 | | | 1.5 | 2.1 | 0.5 | 0.5 | | | | |
| | YELLOW-4 | | | | | | | | 3.1 | | | | | | | | | |
| | BLACK | | | | | | | | | | | | | | 2.0 | 2.0 | | |
| | WHITE | | | | | | | | | | | | | | | | 20.0 | |
| | AMINE BASED DISPERSANT A | 0.7 | 0.7 | 1.5 | 1.5 | 1.5 | 1.5 | 1.5 | 1.5 | 1.5 | 1.5 | 1.5 | 1.5 | 1.5 | 0.7 | 0.7 | 5.0 | |
| | PEA | 12.1 | 12.1 | 14.5 | 14.5 | 16.0 | 16.0 | 16.0 | 16.0 | 16.0 | 16.0 | 16.0 | 16.0 | 16.0 | 10.6 | 10.6 | 8.2 | |
| POLYMERIZABLE COMPOUND | VEEA | 30.0 | | 32.0 | | 33.0 | 33.0 | 33.0 | | 33.0 | 33.0 | 33.0 | 33.0 | | 40.0 | | 43.9 | 40.2 |
| | EGME | | 30.0 | | 32.0 | | | | 33.0 | | | | | 33.0 | | 4.0 | | |
| | PEA | 23.7 | 23.7 | | | | | | | | | | | | 3.9 | 3.9 | 13.0 | 13.0 |
| | 4-HBA | 17.9 | 17.9 | 35.6 | 35.6 | 28.4 | 28.4 | 28.4 | 28.4 | 28.4 | 28.4 | 28.4 | 28.4 | 28.4 | 23.2 | 23.2 | | 26.5 |
| | R-684 | | | | | | | | | | | | | | | | | 8.0 |
| | A-DPH | | | | | 1.6 | 1.6 | 1.6 | 1.6 | 1.6 | 1.6 | 1.6 | 1.6 | 1.6 | 4.2 | 4.2 | | |
| | A-9300 | | | | | | | | | | | | | | | | 1.5 | |
| OTHER ADDITIVES | MEHQ | 0.2 | 0.2 | 0.2 | 0.2 | 0.2 | 0.2 | 0.2 | 0.2 | 0.2 | 0.2 | 0.2 | 0.2 | 0.2 | 0.2 | 0.2 | 0.2 | 0.1 |
| | UV3500 | 0.2 | 0.2 | 0.2 | 0.2 | 0.2 | 0.2 | 0.2 | 0.2 | 0.2 | 0.2 | 0.2 | 0.2 | 0.2 | 0.2 | 0.2 | 0.2 | 0.2 |
| PHOTOPOLYMERIZATION INITIATOR | 819 | 7.0 | 7.0 | 7.0 | 7.0 | 7.0 | 7.0 | 7.0 | 7.0 | 7.0 | 7.0 | 7.0 | 7.0 | 7.0 | 7.0 | 7.0 | 3.0 | 5.0 |
| | TPO | 5.0 | 5.0 | 4.0 | 4.0 | 6.0 | 6.0 | 6.0 | 6.0 | 6.0 | 6.0 | 6.0 | 6.0 | 6.0 | 3.0 | 3.0 | 5.0 | 7.0 |
| | DETX-S | 1.0 | 1.0 | 1.0 | 1.0 | 3.0 | 3.0 | 3.0 | 3.0 | 3.0 | 3.0 | 3.0 | 3.0 | 3.0 | 5.0 | 5.0 | | |
| TOTAL | | 100.0 | 100.0 | 100.0 | 100.0 | 100.0 | 100.0 | 100.0 | 100.0 | 100.0 | 100.0 | 100.0 | 100.0 | 100.0 | 100.0 | 64.0 | 100.0 | 100.0 |

FIG. 13B

| | | | | | | | | | | | | | | | | | | |
|---|---|---|---|---|---|---|---|---|---|---|---|---|---|---|---|---|---|---|
| INK SET | 1 | 1 | | 1 | | 1 | | | | | | | | | 1 | | 1 | 1 |
| | 2 | 1 | | 1 | | | 1 | | | | | | | | 1 | | 1 | 1 |
| | 3 | 1 | | 1 | | | | 1 | | | | | | | 1 | | 1 | 1 |
| | 4 | 1 | | 1 | | | | | | 1 | | | | | 1 | | 1 | 1 |
| | 5 | 1 | | 1 | | | | | | | 1 | | | | 1 | | 1 | 1 |
| | 6 | 1 | | 1 | | | | | | | | 1 | | | 1 | | 1 | 1 |
| | 7 | 1 | | 1 | | | | | | | | | 1 | | 1 | | 1 | 1 |
| | 8 | | 1 | 1 | | 1 | | | | | | | | | 1 | | 1 | 1 |
| | 9 | 1 | | | 1 | | 1 | | | | | | | | | 1 | 1 | 1 |
| | 10 | 1 | | 1 | | | | | 1 | | | | | | 1 | | 1 | 1 |
| | 11 | 1 | | 1 | | | | | | | | | | 1 | 1 | | 1 | 1 |
| | 12 | | 1 | 1 | | | | | 1 | | | | | | | 1 | 1 | 1 |
| | 13 | | 1 | 1 | | | | | | | | | | 1 | | 1 | 1 | 1 |
| | 14 | 1 | | | 1 | | | | 1 | | | | | | 1 | | 1 | 1 |
| | 15 | 1 | | | 1 | | | | | | | | | 1 | 1 | | 1 | 1 |
| | 16 | | 1 | | 1 | | | | 1 | | | | | | | 1 | 1 | 1 |
| | 17 | | 1 | | 1 | | | | | | | | | 1 | | 1 | 1 | 1 |

FIG. 14

EVALUATION RESULTS OF WRINKLES

| | | FIRST EMBODIMENT | SECOND EMBODIMENT | THIRD EMBODIMENT | FOURTH EMBODIMENT | FIFTH EMBODIMENT | COMPARATIVE EXAMPLE |
|---|---|---|---|---|---|---|---|
| INK SET | 1 | A | A | A | A | A | B |
| | 2 | A | A | A | A | A | B |
| | 3 | A | A | A | A | A | B |
| | 4 | A | A | A | A | A | B |
| | 5 | A | A | A | A | A | B |
| | 6 | A | A | A | A | A | B |
| | 7 | A | A | A | A | A | B |
| | 8 | A | A | A | A | A | B |
| | 9 | A | A | A | A | A | B |
| | 10 | A | A | A | A | A | C |
| | 11 | A | A | A | A | A | C |
| | 12 | A | A | A | A | A | C |
| | 13 | A | A | A | A | A | C |
| | 14 | A | A | A | A | A | C |
| | 15 | A | A | A | A | A | C |
| | 16 | A | A | A | A | A | C |
| | 17 | A | A | A | A | A | C |

FIG. 15

EVALUATION RESULTS OF SURFACE GLOSS

| | | FIRST EMBODIMENT | SECOND EMBODIMENT | THIRD EMBODIMENT | FOURTH EMBODIMENT | FIFTH EMBODIMENT | COMPARATIVE EXAMPLE |
|---|---|---|---|---|---|---|---|
| INK SET | 1 | A | A | A | A | A | C |
| | 2 | A | A | A | A | A | C |
| | 3 | A | A | A | A | A | C |
| | 4 | A | A | A | A | A | C |
| | 5 | A | A | A | A | A | C |
| | 6 | A | A | A | A | A | C |
| | 7 | A | A | A | A | A | C |
| | 8 | A | A | A | A | A | C |
| | 9 | A | A | A | A | A | C |
| | 10 | B | B | B | B | B | D |
| | 11 | B | B | B | B | B | D |
| | 12 | B | B | B | B | B | D |
| | 13 | B | B | B | B | B | D |
| | 14 | B | B | B | B | B | D |
| | 15 | B | B | B | B | B | D |
| | 16 | B | B | B | B | B | D |
| | 17 | B | B | B | B | B | D |

FIG. 16

SENSORY EVALUATION RESULTS

| | | FIRST EMBODIMENT | SECOND EMBODIMENT | THIRD EMBODIMENT | FOURTH EMBODIMENT | FIFTH EMBODIMENT | COMPARATIVE EXAMPLE |
|---|---|---|---|---|---|---|---|
| INK SET | 1 | A | A | A | A | A | C |
| | 2 | A | A | A | A | A | C |
| | 3 | A | A | A | A | A | C |
| | 4 | A | A | A | A | A | C |
| | 5 | A | A | A | A | A | C |
| | 6 | A | A | A | A | A | C |
| | 7 | A | A | A | A | A | C |
| | 8 | A | A | A | A | A | C |
| | 9 | A | A | A | A | A | C |
| | 10 | B | B | B | B | B | C |
| | 11 | B | B | B | B | B | C |
| | 12 | B | B | B | B | B | C |
| | 13 | B | B | B | B | B | C |
| | 14 | B | B | B | B | B | C |
| | 15 | B | B | B | B | B | C |
| | 16 | B | B | B | B | B | C |
| | 17 | B | B | B | B | B | C |

PRINTING APPARATUS AND PRINTING METHOD

CROSS-REFERENCE TO RELATED APPLICATIONS

The entire disclosure of Japanese Patent Application No. 2012-103514, filed Apr. 27, 2012 is expressly incorporated by reference herein.

BACKGROUND

1. Technical Field

The present invention relates to a printing apparatus and a printing method.

2. Related Art

Ink jet type printing apparatuses which perform printing on a medium by ejecting ink are known. Among such printing apparatuses, there are printing apparatuses which eject ink (UV ink) which is cured by the irradiation of light (for example, ultraviolet light (UV), visible light, or the like). In the printing apparatuses of this type, after UV ink is ejected from nozzles onto the medium, light is irradiated onto the dots which are formed on the medium. In this manner, the dots are cured and fixed to the medium (for example, refer to JP-A-2008-265285). For this reason, it is possible to form dots even with respect to a medium (for example, a film) which does not absorb ink.

In the printing apparatuses which eject the UV ink, there are cases where ultraviolet light is irradiated to the UV ink in two stages. In the first stage, the ultraviolet light is irradiated to the UV ink on the medium, whereby the wetting and spreading of the UV ink is controlled and the bleeding with the UV ink which is further ejected onto the medium thereafter is suppressed. In the second stage, ultraviolet light is irradiated such that the irradiation energy (integrated quantity of light) is stronger than the first stage, and the UV ink is completely cured. The first stage is sometimes called "pre-curing" or "pinning" and the second stage is called the "main curing".

Yellow UV ink absorbs ultraviolet light more easily than cyan or magenta UV inks. For this reason, during the pre-curing which irradiates ultraviolet light with comparatively weak irradiation energy, ultraviolet light is absorbed at the surface of the yellow ink and the ultraviolet light may not reach the inner portion of the yellow ink. In such a case, only the surface is cured and the inner portion enters a state of having fluidity. When ultraviolet light is irradiated with strong irradiation energy to the yellow ink in this state and the main curing is performed, wrinkles are generated in the surface (the surface which has already been cured) due to the yellow ink of the inner portion undergoing curing shrinkage.

In addition, in a case where a polymerizable compound includes one type or two or more types which are selected from a group consisting of acrylate 2-(2-vinyloxyethoxy) ethyl, 3-oxa-5-hexene-1-ol, phenoxyethyl acrylate, 4-hydroxybutyl acrylate, tricyclodecane dimethylol diacrylate, dipentaerythritol hexaacrylate, and ethoxylated isocyanurate triacrylate, wrinkles are remarkably generated. In particular, in a case where the components of the yellow UV ink include acrylate 2-(2-vinyloxyethoxy)ethyl, wrinkles are remarkably generated. Since there is no inhibition of polymerization by moisture or bases and there is no polymerization inhibition by oxygen in acrylate 2-(2-vinyloxyethoxy)ethyl, the effect is more effective, whereby the above-described problem is more remarkably generated.

In addition, in a case where the components of the yellow UV ink include one type or more of pigment consisting of C. I. Pigment Yellow 150, 155, and 180, the wrinkles are even more remarkably generated.

SUMMARY

An advantage of some aspects of the invention is to suppress the generation of wrinkles of yellow ink.

According to an aspect of the invention, there is provided a printing apparatus including: a transport unit which transports a medium in a transport direction; a first head; a first light source which is provided further to the downstream side in the transport direction than the first head; a second head which is provided further to the downstream side in the transport direction than the first head and the first light source; and a second light source which is provided further to the downstream side in the transport direction than the second head and which irradiates light with a stronger irradiation energy than the irradiation energy of the first light source, in which the first head ejects ink of one color of any among magenta ink, cyan ink, and black ink onto a medium, and the second head ejects yellow ink onto the medium.

BRIEF DESCRIPTION OF THE DRAWINGS

The invention will be described with reference to the accompanying drawings, wherein like numbers reference like elements.

FIG. 11A is a table of the irradiation energy (integrated quantity of light) which is necessary in the main curing of the color inks and the clear ink.

FIG. 11B is a table of the irradiation intensity (illuminance) and irradiation energy (integrated quantity of light) of each light source.

FIG. 13A is a table which shows the ink composition of each color and FIG. 13B is a table which shows ink sets.

FIG. 14 is a table which shows the results of evaluating wrinkles.

FIG. 15 is a table which shows the results of evaluating the surface glossiness.

FIG. 16 is a table which shows the results of sensory evaluation.

DESCRIPTION OF EXEMPLARY EMBODIMENTS

Figure 1:
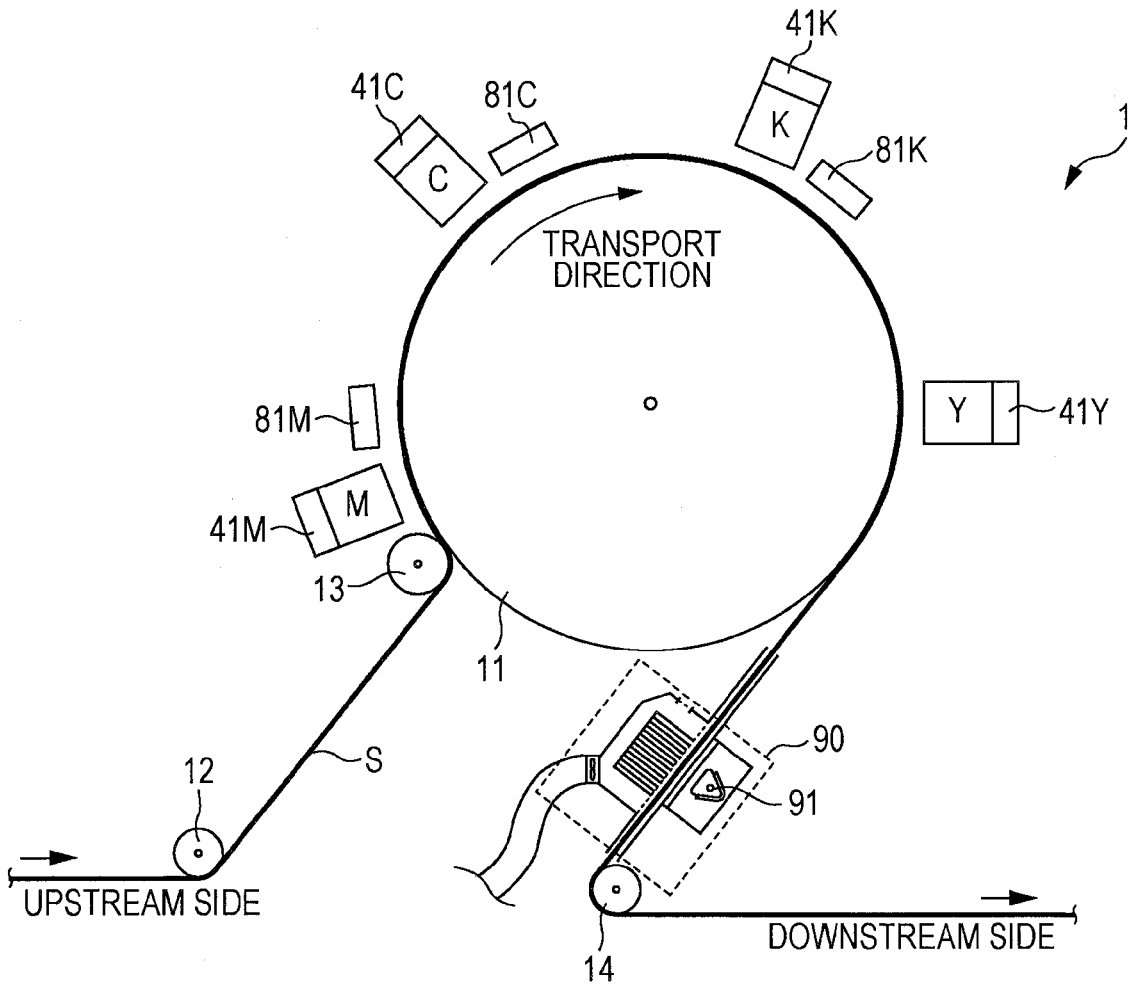
FIG. 1 is a schematic side surface view of a printing apparatus of a first embodiment.

According to the description of the present specification and the attached drawings, at least the following matters will be made apparent.

A printing apparatus which includes a transport unit which transports a medium in a transport direction; a first head; a first light source which is provided further to the downstream side in the transport direction than the first head; a second head which is provided further to the downstream side in the transport direction than the first head and the first light source; and a second light source which is provided further to the downstream side in the transport direction than the second head and which irradiates light with a stronger irradiation energy than the irradiation energy of the first light source, in which the first head ejects ink of one color of any among magenta ink, cyan ink, and black ink onto a medium, and the second head ejects yellow ink onto the medium will become apparent.

According to such a printing apparatus, it is possible to suppress the generation of wrinkles in the yellow ink.

The printing apparatus is provided with a printing apparatus ink set, the printing apparatus ink set has the magenta ink, the cyan ink, the yellow ink and the black ink, the magenta ink, the cyan ink, the yellow ink and the black ink contain a pigment, a polymerizable compound, and a photopolymerization initiator, and the polymerizable compound preferably includes one type or two or more types which are selected from a group consisting of acrylate 2-(2-vinyloxyethoxy) ethyl, 3-oxa-5-hexene-1-ol, phenoxyethyl acrylate, 4-hydroxybutyl acrylate, tricyclodecane dimethylol diacrylate, dipentaerythritol hexaacrylate, and ethoxylated isocyanurate triacrylate. In particular, the polymerizable compound preferably includes acrylate 2-(2-vinyloxyethoxy)ethyl. Since wrinkles are easily generated in the case of such an ink composition, this is particularly effective.

In the printing apparatus, the yellow ink contains a pigment, a polymerizable compound, and a photopolymerization initiator, the polymerizable compound includes one type or two or more types which are selected from a group consisting of acrylate 2-(2-vinyloxyethoxy)ethyl, 3-oxa-5-hexene-1-ol, phenoxyethyl acrylate, 4-hydroxybutyl acrylate, tricyclodecane dimethylol diacrylate, dipentaerythritol hexaacrylate, and ethoxylated isocyanurate triacrylate, and the pigment is preferably one type or two or more types which are selected from a group consisting of C. I. Pigment Yellow 150, 155, and 180. Since wrinkles are easily generated in the case of such an ink composition, this is particularly effective.

The printing apparatus preferably has a third light source which is provided further to the upstream side in the transport direction than the first head and which irradiates light with a weaker irradiation energy than the irradiation energy of the second light source; and a third head which is provided further to the upstream side in the transport direction than the third light source, in which the second head ejects the black ink onto the medium, and the third head ejects the magenta ink or the cyan ink onto the medium. Even in such a case, since the head which ejects the yellow ink is provided further to the downstream side in the transport direction than the head which ejects other color inks, it is possible to suppress the generation of wrinkles in the yellow ink.

The second light source is preferably a main curing light source. In this manner, since the main curing is performed without pre-curing the yellow ink, the ultraviolet light reaches the inner portion of the yellow dots and it is possible to suppress the generation of wrinkles in the yellow dots.

The printing apparatus is provided with a fourth head which is arranged further to the downstream side in the transport direction than the second light source and which ejects clear ink, which is cured by irradiation of light, onto the medium; and a fourth light source which is arranged further to the downstream side in the transport direction than the fourth head, in which the fourth light source irradiates light with a stronger irradiation energy than the irradiation energy of the second light source. In this manner, it is possible to suppress the bleeding of the yellow ink and the clear ink.

The printing apparatus desirably has a fifth head which is arranged further to the downstream side in the transport direction than the second light source and which ejects background ink, which is cured by irradiation of light. In this manner, it is possible to suppress the bleeding of the yellow ink and the background ink.

The printing apparatus preferably further includes a sixth head which ejects a yellow ink with a higher light transmittance than the yellow ink; and a sixth light source which is provided further to the downstream side in the transport direction than the sixth head and which irradiates light with a stronger irradiation energy than the irradiation energy of the first light source, in which the second yellow ink is coated on a medium which is a transparent medium and a pale yellow image which has optical transparency is formed. In this manner, when the printed matter is attached to a glossy surface with a silver color, it is possible to express a golden color.

A printing method performing ejecting magenta ink which is cured by irradiating light while transporting the medium in the transport direction and forming magenta dots on the medium, irradiating the light to the magenta dots, ejecting cyan ink which is cured by irradiating light and forming cyan dots on the medium, irradiating the light to the cyan dots, ejecting black ink which is cured by irradiating light and forming black dots on the medium, irradiating the light to the black dots, ejecting yellow ink which is cured by irradiating light to a region where the magenta dots, the cyan dots and the black dots which are irradiated with light are formed and forming yellow dots on the medium, and irradiating light with an irradiation energy which is weaker than the irradiation energy which is irradiated to the magenta dots, the cyan dots, and the black dots, after the yellow dots are formed.

According to such a printing method, it is possible to suppress the generation of wrinkles in the yellow ink.

First Embodiment

Overview of Printing Apparatus

Figure 2:
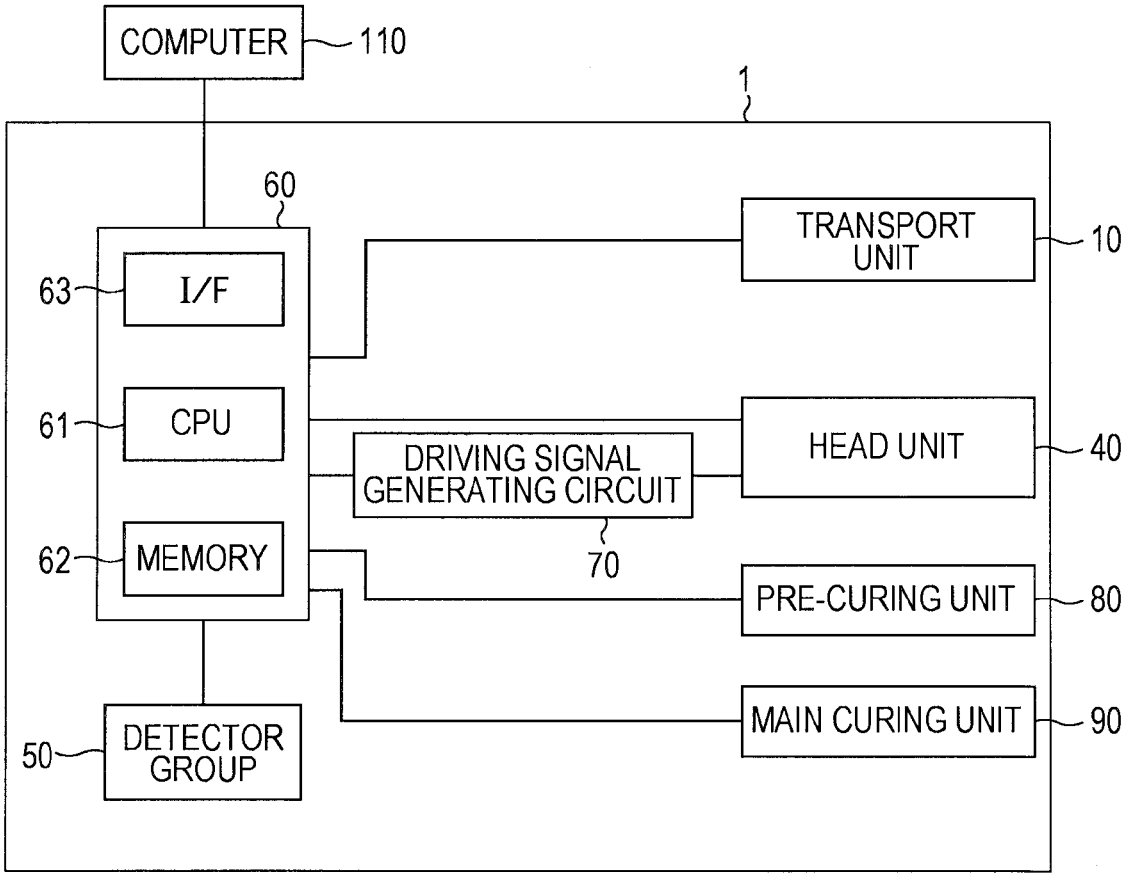
FIG. 2 is a block diagram of the printing apparatus.

FIG. 1 is a schematic side surface view of the printing apparatus 1 of a first embodiment. FIG. 2 is a block diagram of the printing apparatus 1.

The printing apparatus 1 is provided with a transport unit 10, a head unit 40, a detector group 50, a controller 60, a driving signal generating circuit 70, a pre-curing unit 80, and a main curing unit 90.

The transport unit 10 has a function of transporting the medium. In the following description, the direction in which the medium is transported is referred to as the transport direction. The transport unit 10 has the drum 11, a first roller 12, a second roller 13, and a third roller 14. The medium is supplied from a supply unit (which is not shown) at the upstream side of the transport unit 10 and wound by a winding roller (which is not shown) at the downstream side of the transport unit 10. The medium is pulled to a predetermined tension between the first roller 12 to the third roller 14 and is in close contact with the surface of the drum 11. Then, the medium is transported by the rotation of the drum 11. The medium may be paper or may be a transparent medium S.

The head unit 40 has a magenta head unit 41M, a cyan head unit 41C, the black head unit 41K, and a yellow head unit 41Y in order from the transport direction upstream side. A color image is printed using a subtractive color method using magenta ink which is ejected by the magenta head unit 41M, cyan ink which is ejected by the cyan head unit 41C and yellow ink which is ejected by the yellow head unit 41Y. In addition, black ink ejected from the black head unit 41K is also used in the printing of the color image. In the following description, the magenta ink, the cyan ink, the yellow ink, and the black ink are sometimes referred to as color inks.

The head units of each color are provided along the surface of the drum 11. In addition, the head units of each color eject UV ink. The UV ink is ink which has a property of being cured when irradiated with ultraviolet light. Description will be given below of the compositions of the UV inks of the printing apparatus ink set (ink of each color) which is provided in the printing apparatus 1.

Incidentally, the magenta ink has a property that the coloring material for expressing the magenta color is not easily broken down by ultraviolet light when a predetermined wavelength is absorbed. For this reason, in the present embodiment, the magenta head unit 41M is arranged further to the transport direction upstream side than the head units which eject the other color inks.

In a case where the magenta head unit which is one of the three base colors of the subtractive color method is arranged at the far upstream side, normally, the remaining two base color head units (the cyan head unit 41C and the yellow head unit 41Y) are arranged next, and the black head unit 41K which is not one of the three base colors is arranged last. However, in the present embodiment, regardless of whether the magenta head unit 41M is arranged at the far upstream side, the yellow head unit 41Y is arranged further to the transport direction downstream side than the black head unit 41K. The reason for this will be apparent in the description of the comparative example to be described later.

The detector group 50 represents various types of detector which detect information of each portion of the printing apparatus 1. For example, an encoder (which is not shown) or the like which detects the rotation angle of the drum is included in the detector group 50. The detector group 50 sends a detection signal to the controller 60.

The controller 60 is a control unit for performing control of the printing apparatus 1. The controller 60 has a CPU 61, a memory 62, and an interface unit 63. The CPU 61 is a central processing unit for performing overall control of the printing apparatus 1. The memory 62 is a storage unit for securing the operation region of the CPU 61, the region which stores the programs, or the like. The CPU 61 controls each unit in accordance with the programs which are stored in the memory 62. The interface unit 63 transmits and receives data between a computer 110 which is an external apparatus and the printing apparatus 1.

The driving signal generating circuit 70 is a circuit which generates a driving signal for driving a driving element such as a piezo element which is included in the head unit 40. By applying the driving signal to the driving element, the driving element is driven and ink droplets are ejected from the nozzles.

The pre-curing unit 80 irradiates ultraviolet light with an intensity which is sufficient to cure (pre-cure) the surface of the UV inks without the UV inks which have landed on the medium bleeding. The pre-curing unit 80 has a magenta light source 81M, a cyan light source 81C, and a black light source 81K in order from the transport direction upstream side. However, a yellow light source for pre-curing is not provided.

The light sources of each color for pre-curing are provided along the surface of the drum 11. In addition, the light sources of each color are provided at the downstream side of the head unit of the corresponding color. In this manner, immediately after the UV ink is landed on the medium and the dots are formed, the ultraviolet light is irradiated from the pre-curing light sources and the dot surfaces of the UV ink are pre-cured. An LED (light emitting diode) or the like is adopted as the light source of each color of the pre-curing unit 80.

The light sources for pre-curing irradiate ultraviolet light (ultraviolet light with an irradiation energy which is weaker than the main curing light source 91) with a comparatively weak irradiation energy which is not sufficient to completely cure the UV inks. This is because the UV inks have a property of repelling ink when completely cured, and there is a concern that the image quality of the color image may decrease if the color ink is repelled.

Here, the irradiation energy (integrated quantity of light) [$mJ/cm^2$] is calculated from the product of the irradiation intensity (illuminance) [$mW/cm^2$] and the irradiation time [s] in the target irradiation surface which is irradiated by the light sources. If the irradiation energy is strong, the curing rate of the polymerizable compound which is included in the UV ink is increased and the UV ink is cured to a greater extent.

The main curing unit 90 irradiates ultraviolet light with an intensity which is able to perform the main curing (complete curing) of the UV ink on the medium. The main curing unit 90 has the main curing light source 91 for irradiating ultraviolet light with irradiation energy which is stronger than the pre-curing light source. The main curing light source 91 is provided in the lower portion of the drum 11. In addition, the main curing light source 91 irradiates ultraviolet light to the medium from when the medium S is separated from the drum 11 to when the medium S reaches the third roller 14. For example, a metal halide lamp or the like is adopted as the main curing light source 91. Here, the main curing unit 90 is provided with a reflecting mirror which reflects the ultraviolet light of the main curing light source 91 to the medium side and fins, fans, ducts, and the like for discharging heat.

Here, the "main curing" refers to the curing until the dots which are formed on the medium reach the state of being cured enough for use as printed matter. The "pre-curing" has the meaning of temporarily fixing (pinning) the ink and refers to curing before the main curing in order to prevent bleeding or color mixing of the dots, and, in general, the conversion rate in the pre-curing is lower than the conversion rate according to the main curing which is performed after the pre-curing. Here, the conversion rate has the meaning of the rate at which the polymerizable compound which is included in the ink composition is converted to a cured product, or in other words, the degree of curing of the ink composition according to the irradiation of the light.

Configuration of Head Unit

Figure 3A:
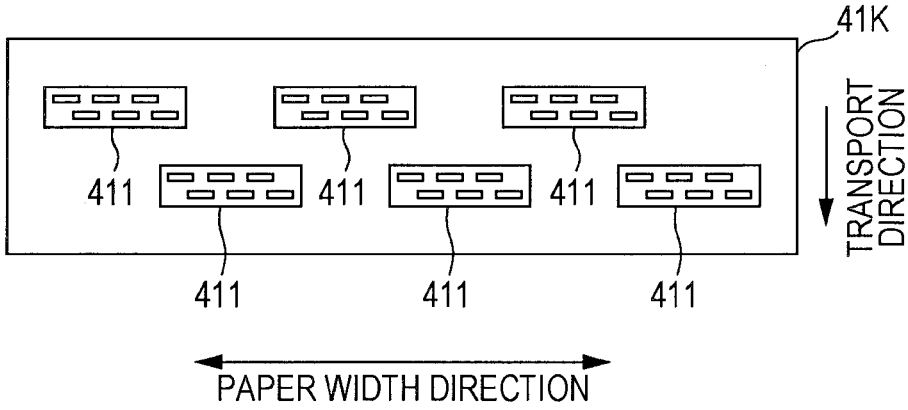
FIG. 3A is an explanatory diagram of the configuration of a black head unit.

FIG. 3A is an explanatory diagram of the configuration of the black head unit 41K. Here, description has been given of the black head unit 41K; however, the configurations of the other color head units are the same.

The black head unit 41K has six head assemblies 411. The six head assemblies 411 are arranged in a staggered manner along the paper width direction. That is, three head assemblies 411 of the transport direction upstream side and three head assemblies 411 of the downstream side are arranged alternately shifted in the paper width direction.

Figure 3B:
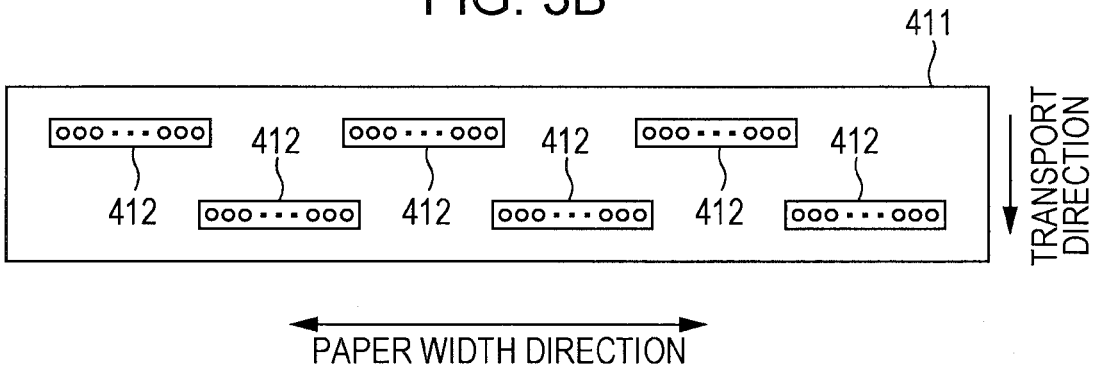
FIG. 3B is an explanatory diagram of the configuration of a head assembly.

FIG. 3B is an explanatory diagram of the configuration of the head assemblies 411. The head assemblies 411 have six heads 412. The six heads 412 are arranged in a staggered manner along the paper width direction. That is, three heads 412 of the transport direction upstream side and three heads 412 of the downstream side are arranged alternately shifted in the paper width direction.

Figure 3C:
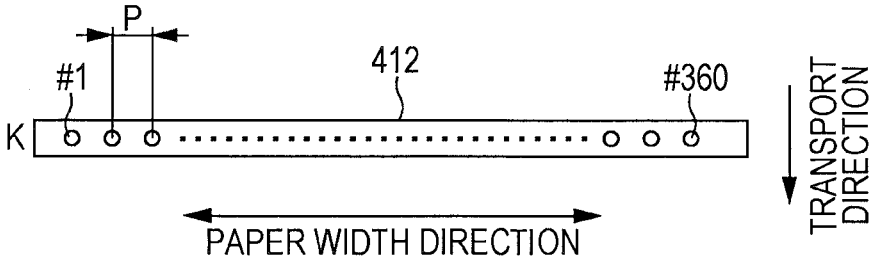
FIG. 3C is an explanatory diagram of the arrangement of nozzles in a head.

FIG. 3C is an explanatory diagram of the arrangement of nozzles in the head 412. The head 412 has 360 nozzles. The 360 nozzles are arranged in one row along the paper width direction and configure a nozzle row. The 360 nozzles are lined up at intervals (nozzle pitches) of 1/360 inch.

By configuring the black head unit 41K as described above, a large number of nozzles which belong to the black head unit 41K are lined up in the paper width direction with intervals of substantially 1/360 inch. In this manner, it is possible for the black head unit 41K to form the dots on the medium with intervals (dot pitches) of 1/360 inch. Here, 36 heads 412 may be arranged in a staggered shape instead of arranging 6 head assemblies in a staggered shape. In short, it is sufficient if a large number of nozzles are lined up in the paper width direction at substantially predetermined nozzle pitches.

Printing Method

The printing apparatus 1 transports the medium to the transport unit 10 and, while transporting the medium, magenta ink is ejected from the magenta head unit 41M, magenta dots are formed on the medium, ultraviolet light is irradiated from the magenta light source 81M to the magenta dots, and the magenta dots are pre-cured.

When the printing apparatus 1 continues the transporting of the medium, the portion where the magenta dots are formed (the region where the magenta image is formed) reaches the cyan head unit 41C. While the printing apparatus 1 transports the medium, cyan ink is ejected from the cyan head unit 41C and cyan dots are formed on the medium. Since the magenta dots are already pre-cured, there is no bleeding of the magenta dots and the cyan dots. The printing apparatus 1 irradiates ultraviolet light from the cyan light source 81C and pre-cures the cyan dots.

When the printing apparatus 1 again continues to transport the medium, the portion where the magenta dots and the cyan dots are formed (the region where the magenta image and the cyan image are formed) reaches the black head unit 41K. While the printing apparatus 1 transports the medium, black ink is ejected from the black head unit 41K and black dots are formed on the medium. Since the magenta dots and the cyan dots are already pre-cured, the black dots do not bleed with the other dots. The printing apparatus 1 irradiates ultraviolet light from the black light source 81K and pre-cures the black dots.

In the present embodiment, before the yellow dots are formed, the color dots of the other colors (magenta, cyan, and black) are formed and these dots are pre-cured. In order to do so, in the present embodiment, the yellow head unit 41Y is arranged further at the transport direction downstream side than the head units which eject the color inks of the other colors and the pre-curing light sources which correspond to the head units. In this manner, that the pre-curing light sources of the other colors irradiate the yellow ink with ultraviolet light with comparatively weak irradiation energy is avoided.

When the printing apparatus 1 continues the transporting of the medium, the portion where the magenta dots, the cyan dots, and the black dots are formed (the region where the magenta image, the cyan image, and the black image are formed) reaches the yellow head unit 41Y. While the printing apparatus 1 transports the medium, yellow ink is ejected from the yellow head unit 41Y and yellow dots are formed on the medium. Since the color dots of the other colors are already pre-cured, the yellow dots do not bleed with the other dots.

In the present embodiment, a yellow light source for pre-curing is not provided. For this reason, the yellow dots are not pre-cured. However, since the color dots of the other colors are not formed after the yellow dots are formed, the yellow dots do not bleed with the other dots.

Since the pre-curing ultraviolet light (ultraviolet light with irradiation energy which is weak in comparison with the main curing ultraviolet light) is not irradiated to the yellow dots, it is possible to suppress the generation of wrinkles on the surface of the yellow dots. If wrinkles are generated on the surface of a bright color such as yellow, light and shading due to the wrinkles are easily visible and the image quality is decreased. In the present embodiment, since it is possible to suppress the generation of wrinkles in the yellow dots, the image quality is improved.

When the printing apparatus 1 again continues to transport the medium, the portion where the color dots are formed (the region where the color image is formed) is irradiated with ultraviolet light by the main curing light source 91 of the main curing unit 90, main curing is performed, and a color image which is configured by the color dots is printed on the medium. The yellow dots, which are not pre-cured, are cured by the ultraviolet light from the main curing light source 91. For this reason, the main curing light source 91 of the first embodiment functions as a yellow light source.

In the present embodiment, the yellow dots are not cured; however, since the yellow dots undergo main curing soon after the yellow dots are formed, the yellow dots do not undergo wetting and spreading. In addition, since the main curing light source 91 irradiates ultraviolet light with an irradiation energy which is stronger than the pre-curing light source, the ultraviolet light reaches the inner portion of the yellow dots during the main curing (the conversion rate of the polymerizable compound is increased). For this reason, wrinkles are not generated in the yellow dots.

Comparison with Comparative Example

Figure 4:
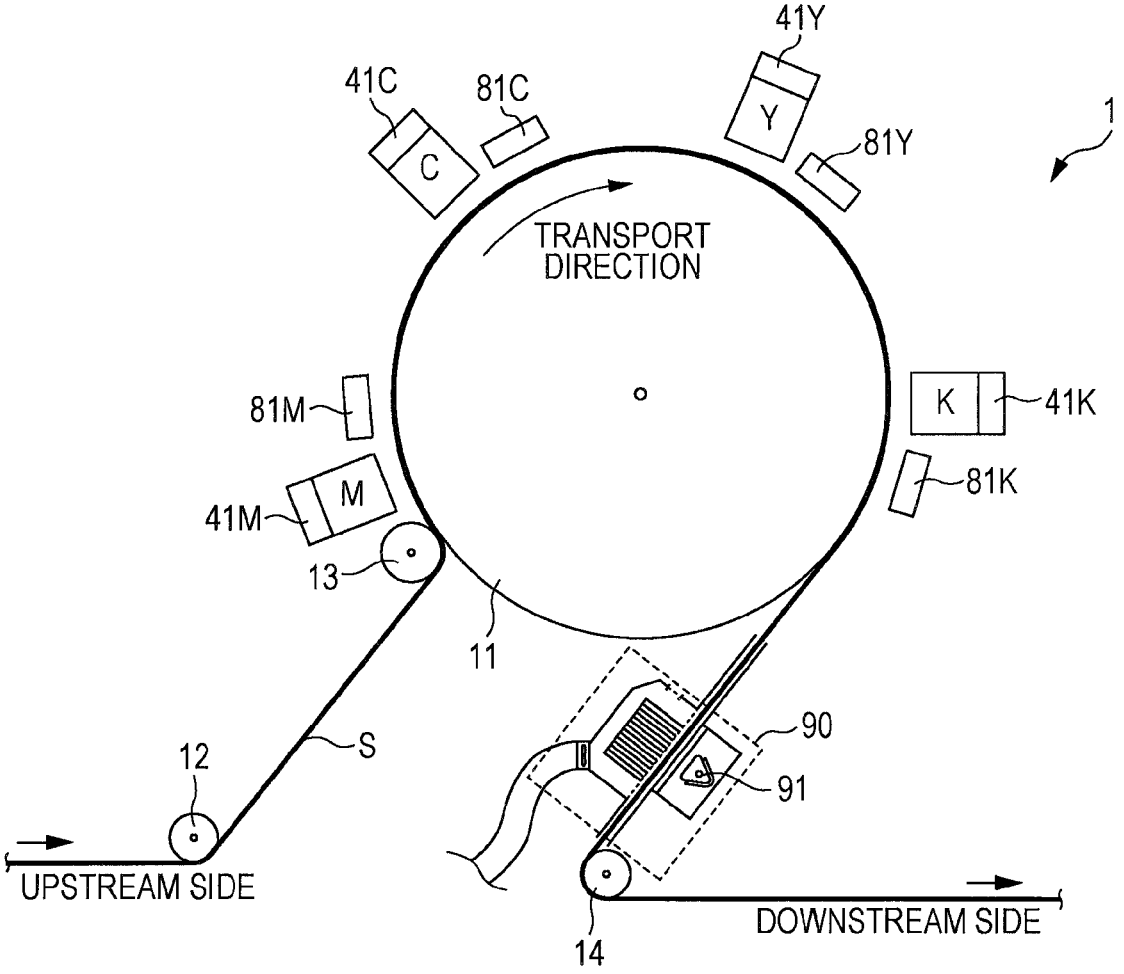
FIG. 4 is an explanatory diagram of the printing apparatus of a comparative example.

FIG. 4 is an explanatory diagram of the printing apparatus 1 of a comparative example. In the comparative example, the points that the yellow head unit 41Y is provided further to the transport direction upstream side than the black head unit 41K and that the yellow light source 81Y for pre-curing the yellow dots is provided are different from the first embodiment.

In the comparative example, the magenta head unit 41M is arranged further to the transport direction upstream side than the head units of other colors. In a case where the magenta (or cyan) head unit which is one of the three base colors of the subtractive color method is arranged at the far upstream side, it is considered that the remaining two base color head units (the cyan head unit 41C and the yellow head unit 41Y) are arranged next, and the black head unit 41K which is not one of the three base colors is arranged last.

However, with such an arrangement, the black ink is ejected after the yellow head unit 41Y forms the yellow dots. Then, in order to prevent the yellow dots bleeding with the black dots, there is a need to provide the yellow light source 81Y for pre-curing the yellow dots.

The yellow light source 81Y for pre-curing irradiates ultraviolet light which not sufficient to completely cure the yellow dots. This is because if the yellow light source 81Y irradiates ultraviolet light with irradiation energy which is strong enough to completely cure the yellow dots, the black ink which is coated thereafter is repelled and the image quality of the color image is decreased.

However, if ultraviolet light is irradiated with comparatively weak irradiation energy to the yellow dots and pre-curing is performed, the ultraviolet light is absorbed by the surface of the yellow dots and the ultraviolet light does not reach the inner portion of the yellow dots. In such a case, only the surface of the yellow dots is cured, and the inner portion enters a state of having fluidity. If the main curing light source 91 irradiates ultraviolet light with strong irradiation energy and performs the main curing with respect to the yellow dots in such a state, wrinkles are generated in the surface (the surface which is already cured) by the yellow ink of the inner portion of the yellow dots undergoing curing shrinkage.

If wrinkles are generated on the surface of a bright color such as yellow, light and shading due to the wrinkles are easily visible. For this reason, in the configuration of the printing apparatus 1 as in the comparative example (in particular, the arrangement of the yellow head unit 41Y), the image quality is decreased.

In contrast, according to the printing apparatus 1 of the first embodiment shown in FIG. 1, the yellow head unit 41Y is arranged further to the transport direction downstream side than the head units which eject color inks of other colors and the light sources for pre-curing which correspond to these head units. In this manner, since the pre-curing ultraviolet light (the normal pre-curing ultraviolet light) is not irradiated to the yellow dots, it is possible to suppress the generation of wrinkles on the surface of the yellow dots. As a result, the image quality is improved.

Second Embodiment

Figure 5:
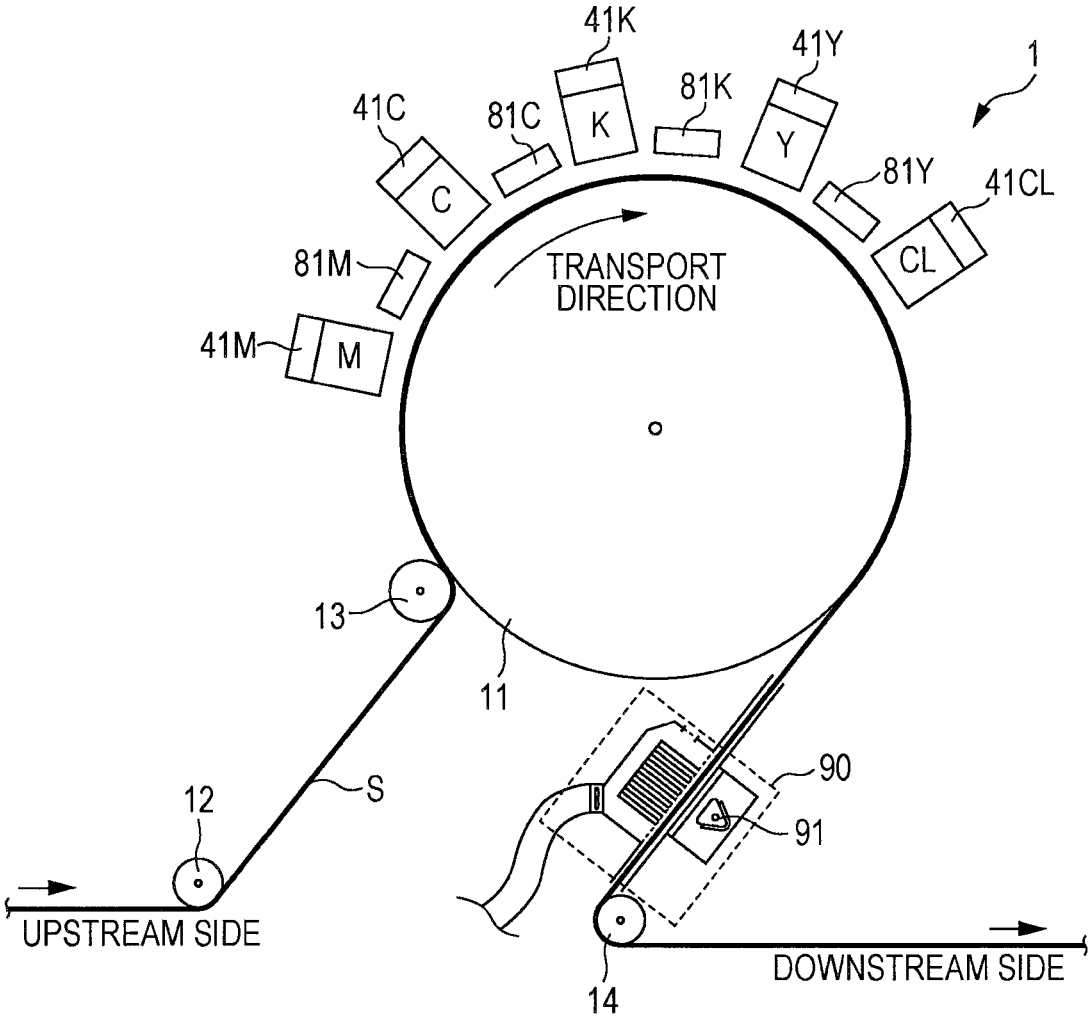
FIG. 5 is a schematic side surface view of the printing apparatus of a second embodiment.

FIG. 5 is a schematic side surface view of the printing apparatus 1 of the second embodiment. In the second embodiment, the point that the yellow light source 81Y and the clear head unit 41CL are provided is different from the first embodiment.

The clear head unit 41CL ejects clear ink. The clear ink is colorless, transparent ink which coats the surface of the color image in order to adjust the glossiness of the color unit or to form a protective film on the surface of the color image. Here, since the clear ink is colorless and transparent, it is different to the color inks which are used in the printing of the color image. The clear ink of the present embodiment is also configured by UV ink which is cured when irradiated with ultraviolet light. Here, a light source for pre-curing the clear ink may be provided at the transport direction downstream side of the clear head unit 41CL.

Since the clear ink is an ink which is coated on the color image, the clear head unit 41CL is provided further to the transport direction downstream side than the head units which eject color ink. For this reason, the clear head unit 41CL is provided further to the transport direction downstream side than the yellow head unit 41Y.

The yellow light source 81Y is provided at the transport direction downstream side of the yellow head unit 41Y. The yellow dots are cured by the yellow light source 81Y irradiating ultraviolet light to the yellow dots, after which it is possible to prevent the coated clear ink and the yellow dots from bleeding.

The yellow light source 81Y of the second embodiment irradiates ultraviolet light with irradiation energy which is stronger than the ultraviolet light which is irradiated by the pre-curing light sources of the other colors (magenta light source 81M, cyan light source 81C, and black light source 81K) such that the ultraviolet light reaches the inner portion of the yellow dots. As a result, the yellow dots are pre-cured with a degree of curing (high conversion rate) which is higher than the normal pre-curing (this pre-curing may be called "strong pre-curing" or "strong pinning"). In this manner, it is possible to suppress the generation of wrinkles in the yellow dots.

The yellow light source 81Y is configured by an LED (light emitting diode) in the same manner as the pre-curing light sources of the other colors. Here, by making a greater current flow in the LED of the yellow light source 81Y than in the pre-curing light sources of the other colors and increasing the irradiation intensity (illuminance) [$mW/cm^2$], the irradiation energy (integrated quantity of light) [$mJ/cm^2$] of the yellow light source 81Y is strengthened. However, even if the irradiation intensity is the same, the irradiation energy may be strengthened by configuring the length of the yellow light source 81Y in the transport direction to be longer than that of the pre-curing light sources of the other colors (by lengthening the irradiation time [s]).

Since the yellow light source 81Y irradiates ultraviolet light with comparatively strong irradiation energy, the yellow dots take on the property of repelling the ink. However, at this stage, since all the color dots are formed (the color image is complete) and no more color ink is to be coated, there is no concern that the color ink will be repelled and the image quality decreased. Since the clear ink which is coated after the strong pinning of the yellow dots is ink which is uniformly coated so as to cover the surface of the color image as well as being colorless, transparent ink, even if the yellow ink is repelled, the image quality of the color image is hardly influenced. For this reason, the yellow light source 81Y is permitted to irradiate ultraviolet light with comparatively strong irradiation energy.

In the printing apparatus 1 of the second embodiment, the yellow head unit 41Y is also arranged further to the transport direction downstream side than the head units which eject color inks of other colors and the light sources for pre-curing which correspond to these head units. In this manner, since the pre-curing ultraviolet light (the normal pre-curing ultraviolet light) is not irradiated to the yellow dots, it is possible to suppress the generation of wrinkles on the surface of the yellow dots.

Third Embodiment

Figure 6:
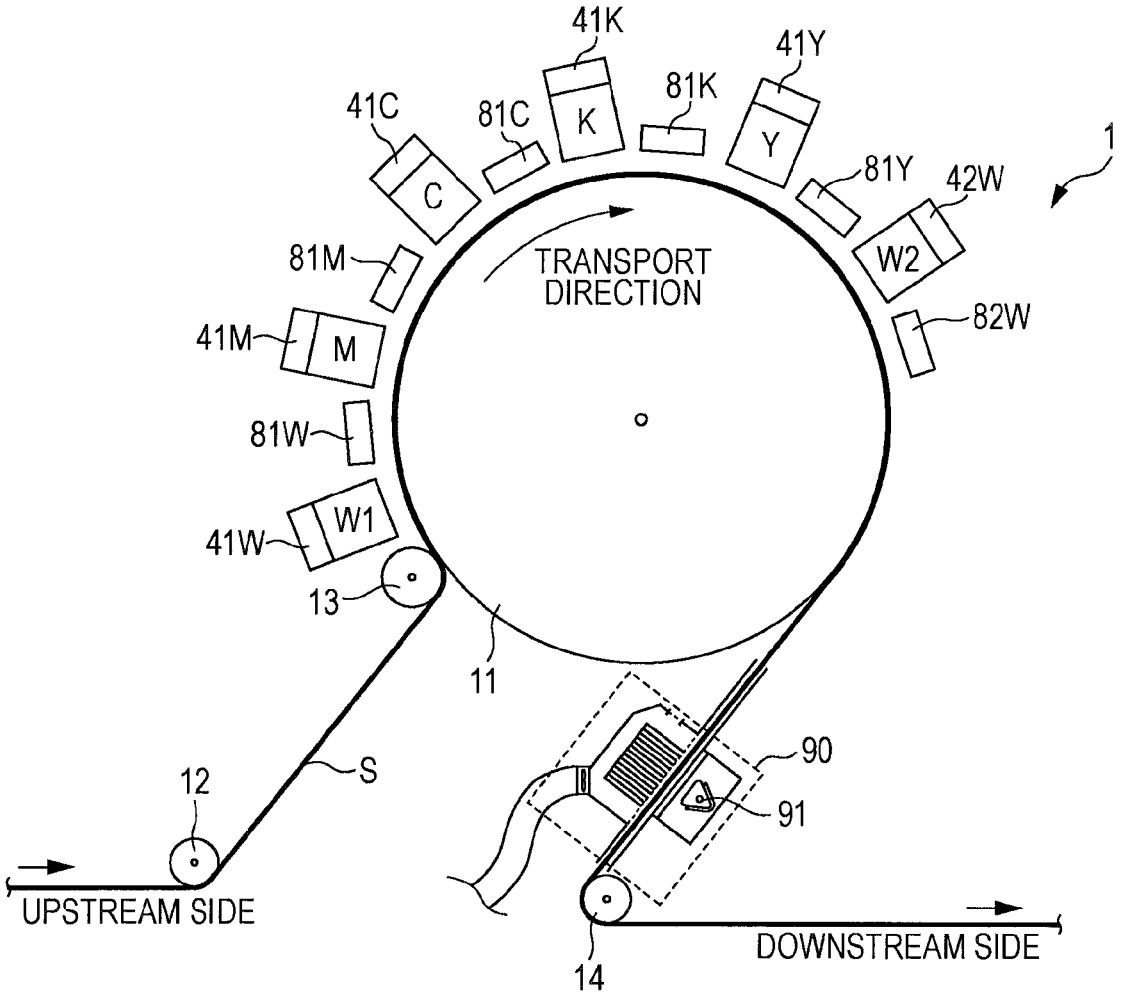
FIG. 6 is a schematic side surface view of the printing apparatus of a third embodiment.

FIG. 6 is a schematic side surface view of the printing apparatus 1 of the third embodiment. In the third embodiment, the point that the yellow light source 81Y, a first white ink head 41W and a second white ink head 42W are provided is different to the first embodiment.

The first white head unit 41W and the second white head unit 42W eject white ink with a white color. The white ink is a background color ink which is used when forming a color image on a transparent medium. Since the visibility of a color image is not good when the color image is formed independently on a transparent medium, the light blocking property (shielding property) is improved and the visibility of the color image is increased by forming a background image with white ink along with the color image. For this reason, the white ink has a lower light transmittance than the color ink, and is an ink with a high light blocking property. The average particle diameter of the pigment of the white ink, for example, is 300 nm to 400 nm and is large in comparison with the average particle diameters (approximately 200 nm) of the pigments of the color inks.

Normally, in a case where the color image is printed on an opaque medium, the first white head unit 41W and the second white head unit 42W are not used. However, with the object of adjusting the color of the medium underlying the color image, white ink may be ejected onto the medium from the first white head unit 41W or the second white head unit 42W.

As methods of printing a background image with the color image, there are surface printing and reverse printing which are described next.

Figure 7A:
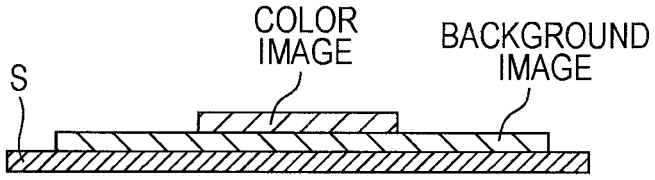
FIG. 7A is an explanatory diagram of an image (surface printing printed image) which is formed by surface printing.

FIG. 7A is an explanatory diagram of an image (surface printing printed image) which is formed by surface printing. "Surface printing" is printing for viewing a printed image from the side (the top side) of the printing surface of the medium. For this reason, in a case where a background image and a color image are formed by "surface printing", a color image is formed on the background image after the background image is formed on the medium.

In a case where surface printing is performed, the printing apparatus 1 forms a background image (white image) on the medium using the first white head unit 41W. That is, the printing apparatus 1 ejects white ink from the first white head unit 41W while transporting the medium, forms white dots on the medium, performs pre-curing by irradiating ultraviolet light to the white dots from the first white light source 81W, and forms a background image. Thereafter, a color image is formed on the background image after the pre-curing using head units further to the transport direction downstream side than the first white head unit 41W. The main curing light source 91 irradiates ultraviolet light to the color image and the background image which is under the color image, and performs the main curing of the color image and the background image.

Figure 7B:
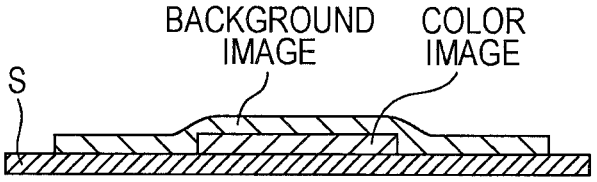
FIG. 7B is an explanatory diagram of an image (reverse printing printed image) which is formed by reverse printing.

FIG. 7B is an explanatory diagram of an image (reverse printing printed image) which is formed by reverse printing. "Reverse printing" is printing for viewing a printed image through a transparent medium (from the rear side of the printing surface of the medium). For this reason, in a case where a background image and a color image are formed by "reverse printing", the background image is formed on the color image after the color image is formed on the medium.

In a case where the reverse printing is performed, the printing apparatus 1 forms the background image (white image) on the medium using the second white head unit 42W. That is, the printing apparatus 1 forms a color image using the head units further to the transport direction upstream side than the second white head unit 42W while transporting the medium, ejects white ink from the second white head unit 42W on the color image after pre-curing, forms white dots on the color image, irradiates ultraviolet light to the white dots from the second white light source 82W to perform pre-curing, and forms a background image. The main curing light source 91 irradiates ultraviolet light to the background image on the color image, and performs the main curing of the color image and the background image.

Here, in FIG. 7A and FIG. 7B, the layers of the background image and the color image are drawn so as to be clearly separated; however, in practice, each layer is not limited to being clearly separated. For example, if there is a gap between the white dots which configure the background image of the surface printing printed image of FIG. 7A, a part of the color dots which configure the color image is formed on the transparent medium S.

In a case where the reverse printing is performed, white dots are formed after the yellow dots are formed on the medium. In order to prevent the bleeding of the yellow dots and the white dots at this time, the yellow light source 81Y is provided. The yellow light source 81Y is provided at the transport direction downstream side of the yellow head unit 41Y.

In the same manner as the second embodiment, the yellow light source 81Y of the third embodiment irradiates ultraviolet light with irradiation energy which is stronger than the ultraviolet light which is irradiated by the pre-curing light sources of the other colors (magenta light source 81M, cyan light source 81C, and black light source 81K) such that the ultraviolet light reaches the inner portion of the yellow dots. As a result, the yellow dots are pre-cured (strong pre-curing, strong pinning) to a curing degree (high conversion rate) which is higher than the normal pre-curing. In this manner, it is possible to suppress the generation of wrinkles in the yellow dots.

Since the yellow light source 81Y irradiates ultraviolet light with comparatively strong irradiation energy, the yellow dots take on the property of repelling the ink. However, at this stage, since all the color dots are formed (the color image is complete) and no more color ink is to be coated, there is no concern that the color ink will be repelled and the image quality decreased. Since the white ink which is ejected from the second white head unit 42W after the curing of the yellow dots is an ink which is coated uniformly so as to cover the surface of the color image in order to improve the light blocking property of the color image, even if the yellow ink is repelled, the image quality of the color image is hardly influenced. For this reason, the yellow light source 81Y is permitted to irradiate ultraviolet light with comparatively strong irradiation energy.

In the printing apparatus 1 of the third embodiment, the yellow head unit 41Y is also arranged further to the transport direction downstream side than the head units which eject color inks of other colors and the light sources for pre-curing which correspond to these head units. In this manner, since the pre-curing ultraviolet light (the normal pre-curing ultraviolet light) is not irradiated to the yellow dots, it is possible to suppress the generation of wrinkles on the surface of the yellow dots.

Fourth Embodiment

Figure 8:
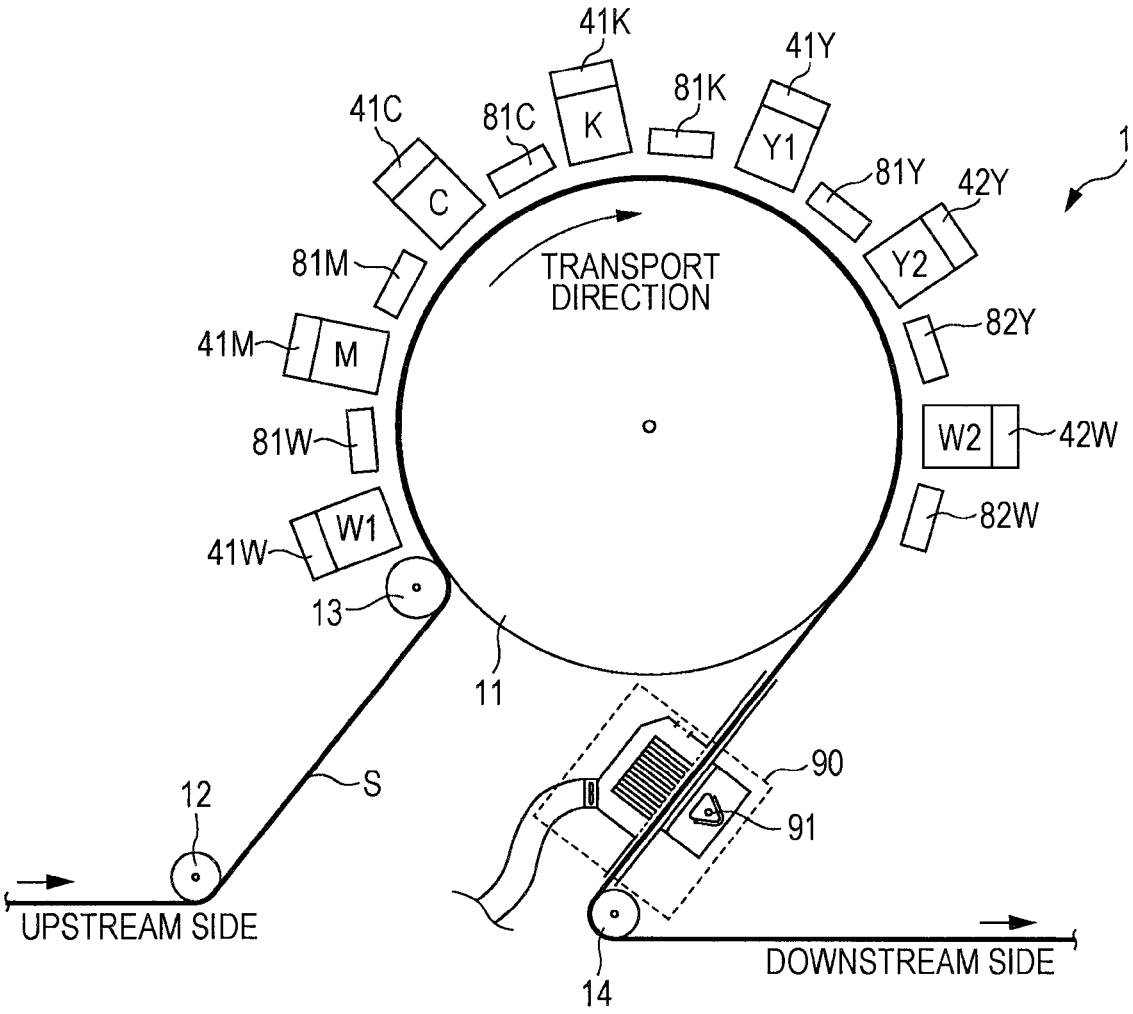
FIG. 8 is a schematic side surface view of the printing apparatus of a fourth embodiment.

FIG. 8 is a schematic side surface view of the printing apparatus 1 of the fourth embodiment. In the fourth embodiment, the point that a second yellow head unit 42Y which ejects yellow ink (below, second yellow ink) which has a higher light transmittance than the previously mentioned yellow ink (below, first yellow ink) and a second yellow light source 82Y are provided is different from the third embodiment.

In the description of the fourth embodiment, the previously mentioned yellow head unit 41Y is called the "first yellow head unit 41Y" in order to be distinguished from the second yellow head unit 42Y. Similarly, the previously mentioned yellow light source 81Y is called the "first yellow light source 81Y".

The second yellow ink which is ejected by the second yellow head unit 42Y is ink which has a higher light transmittance than the first yellow ink. With respect to the fact that there is a need to increase the light blocking property of the color image as much as possible since the color inks (the first yellow ink, cyan ink, and magenta ink) which are used in the printing of the color images print the color image on a transparent medium, the second yellow ink may be an ink with a high light transmittance when used for another purpose. The average particle diameter of the pigment of the second yellow ink is small (100 nm or less) in comparison with the average particle diameter (approximately 200 nm) of the pigment of the first yellow ink.

In the fourth embodiment, by attaching a transparent medium where a pale yellow image is formed with the second yellow ink to a surface with metallic gloss, it is possible to realize an image with a golden color. In this manner, the printing apparatus 1 of the fourth embodiment is able to realize a golden color without using an expensive photoluminescent ink. Description will be given of this point below.

Figure 9A:
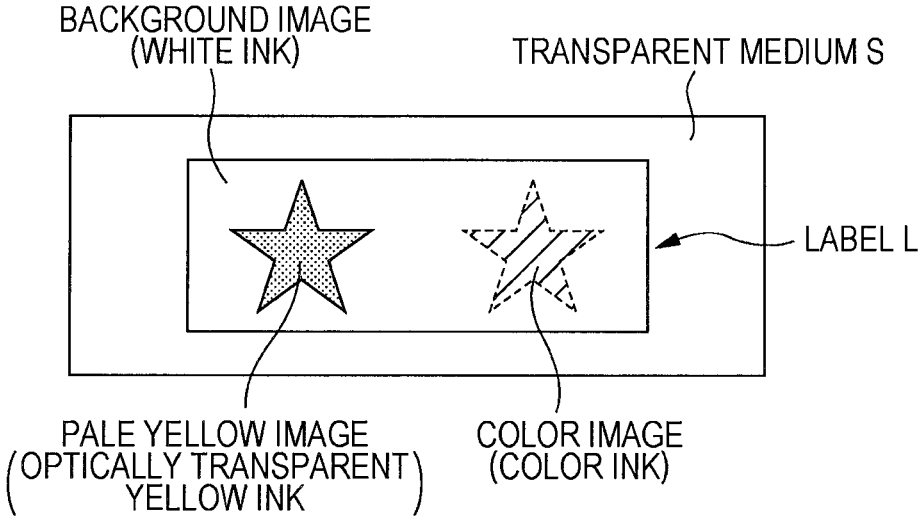
FIGS. 9A and 9B are explanatory diagrams of a printing method of a label.
Figure 9B:
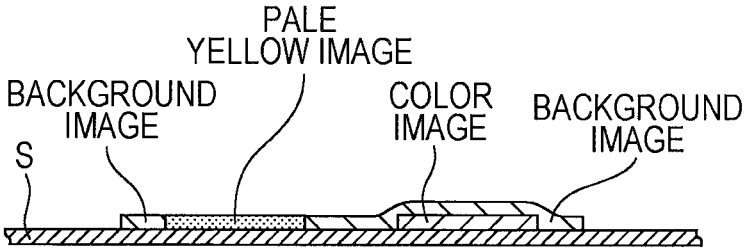

FIGS. 9A and 9B are explanatory diagrams of a printing method of a label L. Here, description will be given of a case where a label L which has colors and a golden star on a white background image is printed.

It is possible to divide this label L into a golden region where a golden image (pale yellow image) is formed and a region other than this. The second yellow ink (yellow ink with a high light transmittance) is coated in the golden region. Since the second yellow ink has a lower light blocking property than the first yellow ink, at this stage a light yellow image (pale yellow image) is printed in the golden region. The white ink and color inks (the first yellow ink, cyan ink, and magenta ink) are not coated in the golden region. In the region other than the golden region, the background image and the color image are formed in accordance with the reverse printing.

The printing apparatus 1 performs the forming of the color dots in the order of magenta, cyan, black, and first yellow and the pre-curing while transporting the medium, thereby forming a color image. Next, the printing apparatus 1 further transports the medium, ejects the second yellow ink from the second yellow head unit 42Y, forms the second yellow dots in the golden region (forms a pale yellow image), irradiates ultraviolet light from the second yellow light source 82Y to the second yellow dots, pre-cures the second yellow dots, and forms the golden image (pale yellow image). The printing apparatus 1 ejects white ink from the second white head unit 42W to the region other than the golden region while transporting the medium, forms white dots on the color image, irradiates ultraviolet light to the white dots from the second white light source 82W to perform pre-curing, and forms a background image. Finally, the printing apparatus 1 further transports the medium where the golden image (pale yellow image), color image, and background image are formed, irradiates ultraviolet light from the main curing light source 91, and performs main curing on the golden image (pale yellow image), color image and background image.

Figure 9C:
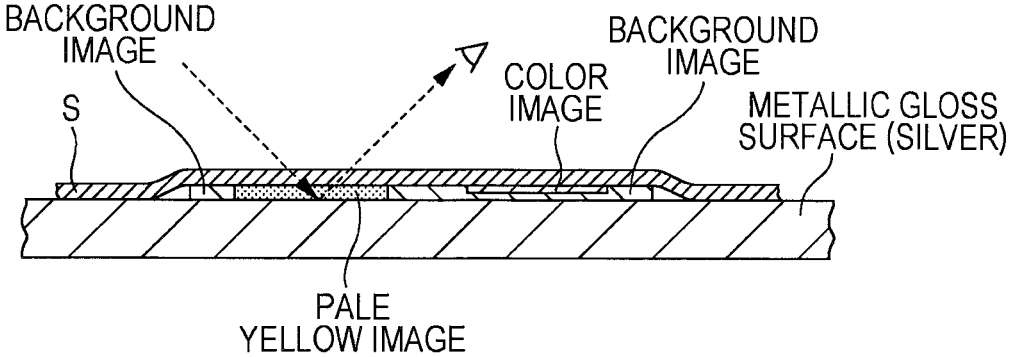
FIG. 9C is an explanatory diagram of the principle of the expression of a golden color.

FIG. 9C is an explanatory diagram of the principle of the expression of the golden color.

When the label L is put in close contact with the metallic gloss surface, the metallic gloss surface is positioned immediately below the pale yellow image. When the label L is wound on an aluminum can or a steel can, the label L is put in close contact with the silver metallic gloss surface, the pale yellow image is seen to have a silver metallic gloss tinge, and the golden color is visible in the golden region.

Since the color image has a light blocking property in comparison with the pale yellow image, it is not easily seen to have a metallic gloss tinge. Furthermore, since the background image is formed on the color image, even if the label L is wound on the silver metallic gloss surface and the color image is seen through the medium, the external light is blocked by the background image, and the color image is not easily seen to have a metallic gloss tinge. For this reason, the color image is seen in the same manner as the case of normal reverse printing even if the label L is in close contact with the silver metallic gloss surface.

In the fourth embodiment, the first yellow light source 81Y and the second yellow light source 82Y irradiate a greater amount of ultraviolet light than the pre-curing light sources of the other colors (the magenta light source 81M, cyan light source 81C, and black light source 81K). In this manner, irradiating the normal ultraviolet light (ultraviolet light with a comparatively weak irradiation energy) for pre-curing to the yellow ink is avoided and the ultraviolet light reaches the inner portion of the yellow ink at the pre-curing stage. As a result, the yellow dots are pre-cured (strong pre-curing, strong pinning) to a curing degree (high conversion rate) which is higher than the normal pre-curing.

Since the first yellow light source 81Y irradiates ultraviolet light with comparatively strong irradiation energy, the first yellow dots take on the property of repelling ink. However, at this stage, since all the color dots are formed (the color image is complete) and no more color ink is to be coated, there is no concern that the color ink will be repelled and the image quality decreased. In addition, since the second yellow ink is coated only in the golden region and not coated in the region where the first yellow dots are formed, there is no concern that the second yellow ink will be repelled. For this reason, the first yellow light source 82Y is permitted to irradiate ultraviolet light with comparatively strong irradiation energy.

Since the second yellow light source 82Y irradiates ultraviolet light with comparatively strong irradiation energy, the second yellow dots take on the property of repelling the ink. However, since the color ink and the white ink are not subsequently coated in the golden region where the second yellow ink is coated, there is no problem of the second yellow dots taking on the property of repelling the ink. For this reason, the second yellow light source 82Y is permitted to irradiate ultraviolet light with comparatively strong irradiation energy.

In the printing apparatus 1 of the fourth embodiment, the first yellow head unit 41Y is also arranged further to the transport direction downstream side than the head units which eject color inks of other colors and the light sources for pre-curing which correspond to these head units. In this manner, since the pre-curing ultraviolet light (the normal pre-curing ultraviolet light) is not irradiated to the first yellow dots, it is possible to suppress the generation of wrinkles on the surface of the first yellow dots.

In addition, in the printing apparatus 1 of the fourth embodiment, the second yellow head unit 41Y is also arranged further to the transport direction downstream side than the head units which eject color inks and the light sources for pre-curing which correspond to these head units. In this manner, since the pre-curing ultraviolet light (the normal pre-curing ultraviolet light) is not irradiated to the second yellow dots, the generation of wrinkles on the pale yellow image with optical transparency is suppressed, and it is possible to realize a high quality golden color.

Fifth Embodiment

Configuration of Printing Apparatus 1

Figure 10A:
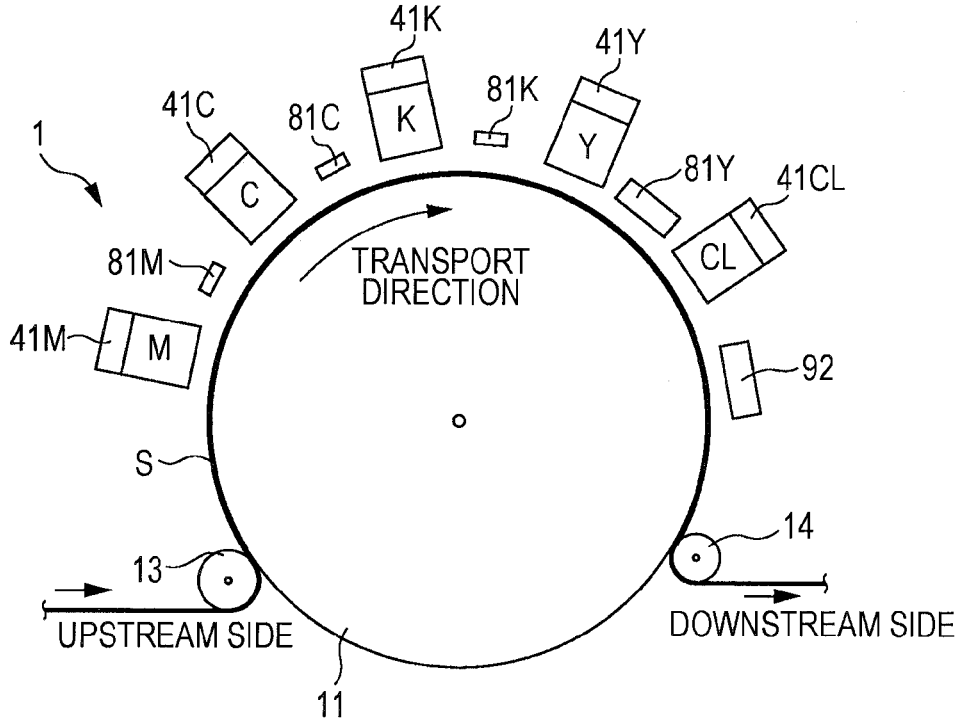
FIGS. 10A and 10B are schematic side surface views of the printing apparatus of a fifth embodiment.
Figure 10B:
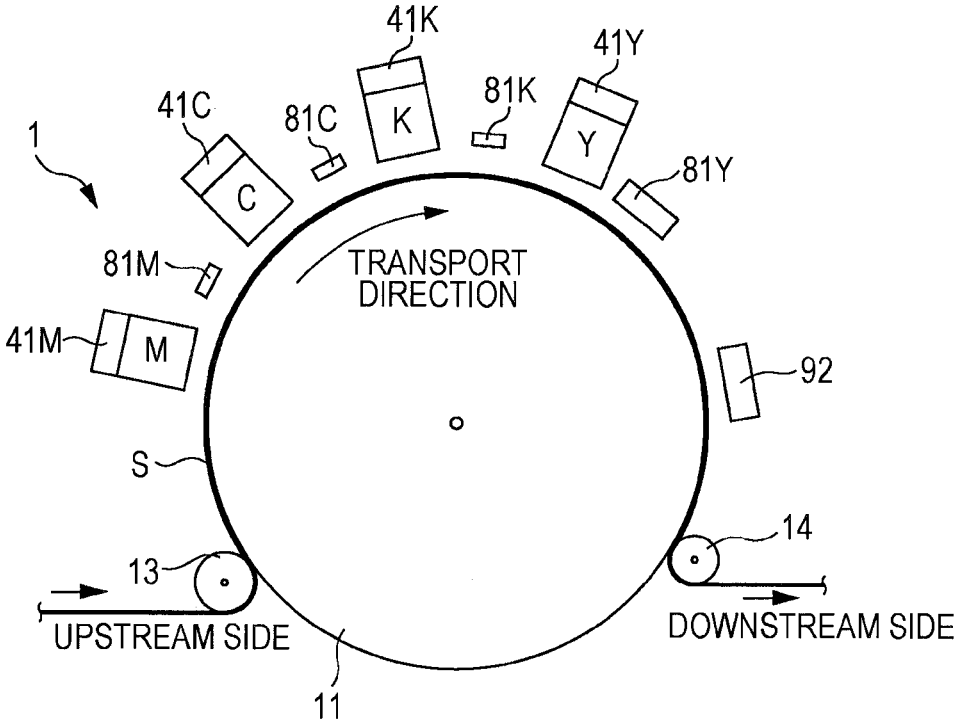

FIGS. 10A and 10B are schematic side surface views of the printing apparatus 1 of the fifth embodiment.

The head unit 40 has the magenta head unit 41M, the cyan head unit 41C, the black head unit 41K, the yellow head unit 41Y, and the clear head unit 41CL in order from the transport direction upstream side. Each head unit is provided along the surface of the drum 11.

Head units which eject color ink (the magenta head unit 41M, the cyan head unit 41C, the black head unit 41K and the yellow head unit 41Y) are equipped as standard in the printing apparatus 1. In contrast, it is possible to understand from comparison of FIG. 10A and FIG. 10B that the clear head unit 41CL is optional equipment and it is possible to arbitrarily select whether or not the printing apparatus 1 is equipped.

FIG. 11A is a table of the irradiation energy (integrated quantity of light) which is necessary in the main curing of the color inks and the clear ink. The irradiation energy (integrated quantity of light) which is necessary in the main curing of the color ink is 500 mJ/cm$^2$ or more. The irradiation energy which is necessary in the main curing of the clear ink is 280 mJ/cm$^2$ or more. Here, the composition of the UV ink of the present embodiment is as shown in the ink set 1 of FIG. 13B which is described below.

For the clear ink the irradiation energy which is necessary in the main curing is less than for the color ink. In other words, if the irradiation energy which is necessary in the main curing of the color ink is Pc and the irradiation energy which is necessary in the main curing of the clear ink is Pcl, Pcl<Pc. It is considered that the reason for this is that since the clear ink does not include color material like the color ink, the ultraviolet light is not absorbed by the color material.

The pre-curing unit 80 has the magenta light source 81M, the cyan light source 81C, the black light source 81K, and the yellow light source 81Y in order from the transport direction upstream side. The light sources of each color for pre-curing are provided along the surface of the drum 11. In addition, the light sources of each color are provided at the downstream side of the head unit of the corresponding color.

The yellow light source 81Y irradiates ultraviolet light with irradiation energy which is stronger than the ultraviolet light which is irradiated by the pre-curing light sources of the other colors (the magenta light source 81M, the cyan light source 81C, and the black light source 81K). As a result, the yellow dots are pre-cured (strong pre-curing, strong pinning) to a curing degree (high conversion rate) which is higher than the normal pre-curing. In this manner, it is possible to suppress the generation of wrinkles in the yellow dots.

The main curing unit 90 has a main curing light source 92 for irradiating ultraviolet light with an irradiation energy which is stronger than the light source for pre-curing. The main curing light source 92 is provided at the downstream side of the clear head unit 41CL.

FIG. 11B is a table of the irradiation intensity (illuminance) and irradiation energy (integrated quantity of light) of each light source. In the present embodiment, since the same LEDs are adopted in all the light sources and the current which flows in the LEDs is set to be the same, all the light sources have the same irradiation intensity (1200 mW/cm$^2$). However, since the lengths of the respective light sources in the transport direction are different (refer to FIG. 12), the irradiation times of the respective light sources are different, and the irradiation energy of each light source is different.

Specifically, the irradiation energies of the normal pre-curing magenta light source 81M, cyan light source 81C, and black light source 81K are 20 mJ/cm$^2$ respectively. The irradiation energy of the yellow light source 81Y for strong pre-curing is 200 mJ/cm$^2$. The irradiation energy of the light source 92 for main curing is 300 mJ/cm$^2$.

In the printing apparatus 1 of the fifth embodiment, the yellow head unit 41Y is also arranged further to the transport direction downstream side than the head units which eject color inks of other colors and the light sources for pre-curing which correspond to these head units. For this reason, since the pre-curing ultraviolet light (ultraviolet light for normal pre-curing where the irradiation energy is 20 mJ/cm$^2$) is not irradiated to the yellow dots, it is possible to suppress the generation of wrinkles on the surface of the yellow dots.

Relationship of Irradiation Energy P

In the present embodiment, when the irradiation energy of the yellow light source 81Y for strong pre-curing is set to P1 (=200 mJ/cm$^2$), and the irradiation energy of the light source 92 for main curing is set to P2 (=300 mJ/cm$^2$), the irradiation energy Pc (=500 mJ/cm$^2$) which is necessary for the main curing of the color ink has a relationship of $P1<Pc\leq P1+P2$.

Due to the relationship of P1<Pc, the color dots (in particular, the yellow dots which are formed last) do not undergo main curing in the stage where the ultraviolet light is irradiated from the yellow light source 81Y for strong pre-curing. For this reason, since the clear ink is coated before the color dots undergo main curing, the clear ink is suppressed from being repelled by the color dots.

On the other hand, since there is a relationship of $Pc\leq P1+P2$, the color dots are irradiated with ultraviolet light from the light source 92 for main curing to undergo main curing. For this reason, the printing is not completed in a state where the color dots do not undergo main curing.

In the present embodiment, when the irradiation energy which is necessary in the main curing of the color ink is set to Pc (=500 mJ/cm$^2$) and the irradiation energy which is necessary in the main curing of the clear ink is set to Pcl (=280 mJ/cm$^2$), the irradiation energy P2 (=300 mJ/cm$^2$) of the main curing light source 92 has a relationship of PcL<P2<Pc.

Due to the relationship of Pcl<P2, the clear dots are irradiated with ultraviolet light from the light source 92 for main curing to undergo main curing. For this reason, the printing is not completed in a state where the clear dots do not undergo main curing.

On the other hand, due to the relationship of P2<Pc, it is possible to configure the light source 92 for main curing with a light source with weak irradiation energy. For this reason, the light source 92 for main curing of the present embodiment is different to the previously described light source 91 for main curing, and it is possible to provide the light source 92 along the surface of the drum 11 (refer to FIG. 10). Here, since the color dots are irradiated with ultraviolet light from the yellow light source 81Y for strong pre-curing before the ultraviolet light is irradiated from the light source 92 for main curing, even with a relationship of P2<Pc, the color dots are irradiated with ultraviolet light from the light source 92 for main curing to undergo main curing.

In the present embodiment, when the irradiation energy of the normal light source for pre-curing is set to P0 (=20 mJ/cm$^2$) and the number of times of ultraviolet light irradiation from the normal light source for pre-curing with respect to the color dots (here, the magenta dots) which are formed first is set to n (=3 times), there is a relationship of $P0\times n+P1<Pc$. For this reason, the color dots which are formed first do not undergo main curing in the stage where the ultraviolet light is irradiated from the yellow light source 81Y for strong pre-curing. In this manner, since the clear ink is coated before the color dots undergo main curing, the clear ink is suppressed from being repelled by the color dots.

Relationship of Length L of Transport Direction of Light Source

Figure 12:
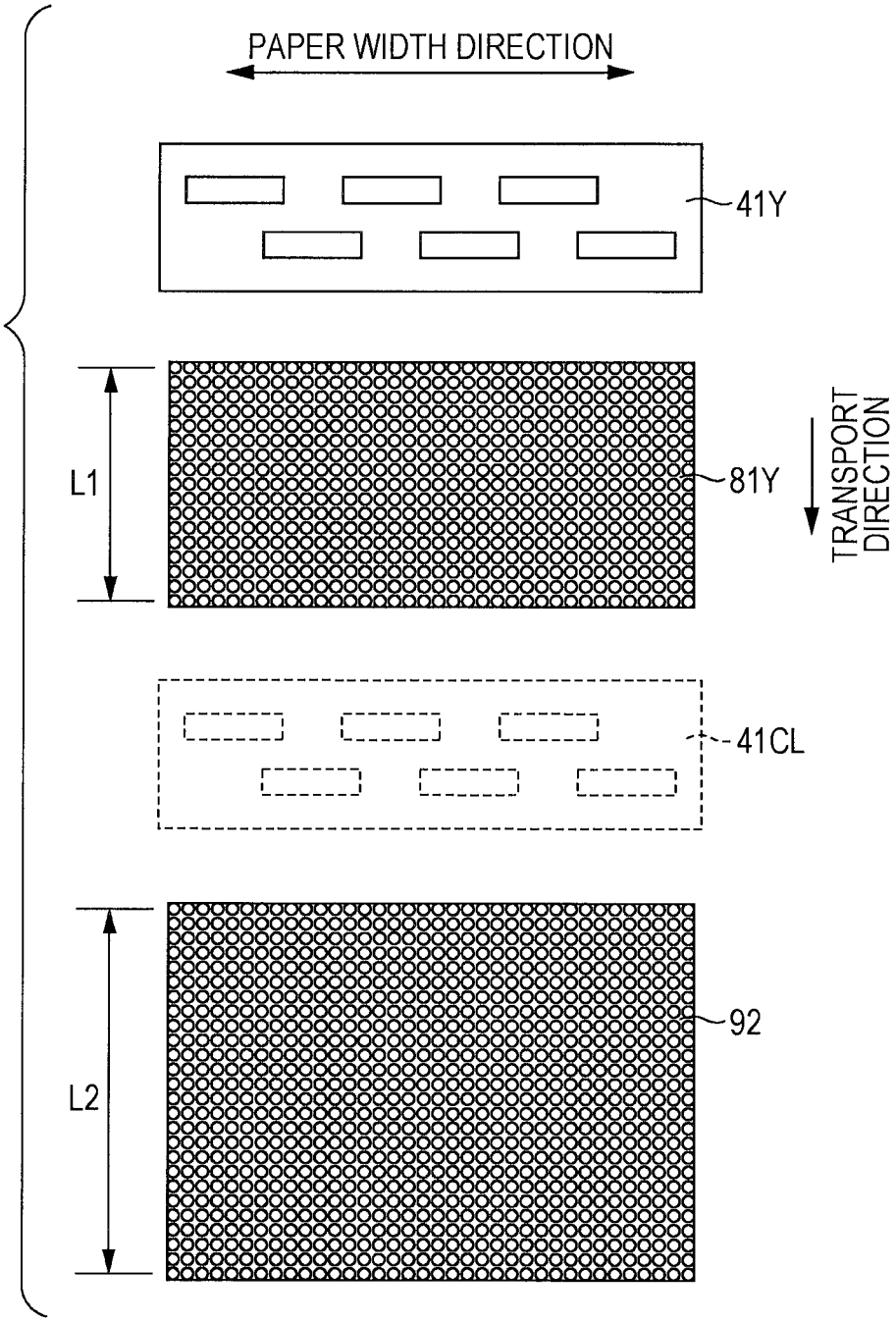
FIG. 12 is a view in which a yellow light source 81Y used for strong pre-curing and a light source used for the main curing are viewed from a drum side.

FIG. 12 is a view in which the yellow light source 81Y used for strong pre-curing and the light source 92 used for the main curing are viewed from the drum 11 side. There is the yellow head unit 41Y at the transport direction upstream side of the yellow light source 81Y for pre-curing. The optionally equipped clear head unit 41CL is described using a dotted line between the yellow light source 81Y for strong pre-curing and the light source 92 for main curing.

A large number of LEDs (light emitting diodes) are two-dimensionally arranged in the respective lower surfaces of the yellow light source 81Y for strong pre-curing and the light source 92 for main curing. Since the current which flows in these LEDs is approximately the same, the irradiation intensity (illuminance) [mW/cm$^2$] of the ultraviolet light of the light source 92 for main curing is approximately the same as the irradiation intensity of the ultraviolet light of the light source for pre-curing.

When the length of yellow light source 81Y for strong pre-curing in the transport direction is set to L1 and the length of the light source 92 for main curing in the transport direction is set to L2, a configuration of L1:L2=200:300 is adopted. In this manner, when the irradiation energy of the yellow light source 81Y for strong pre-curing is set to P1 and the irradiation energy of the light source 92 for main curing is set to P2, it is possible to set P1:P2=200:300. Then, by setting the transport speed to a predetermined speed, it is possible to set the irradiation energy of the light source 92 for main curing to 300 mJ/cm$^2$ while setting the irradiation energy of the yellow light source 81Y to 200 mJ/cm$^2$.

Here, in FIG. 12, each light source is configured by one unit. However, the light sources may be configured by lining up a plurality of small individual units. In such a case, the "length L of the light source in the transport direction" is the total of the lengths in the transport direction of the individual units which are lined up in the transport direction.

Incidentally, in the present embodiment, all the light sources have the same irradiation intensity (refer to FIG. 11B). For this reason, if the irradiation energy P [mJ/cm$^2$] which is necessary in the main curing of the ink shown in FIG. 11A is divided by the irradiation intensity E [mW/cm$^2$], it is possible to calculate the irradiation time T [s] of the ultraviolet light which is necessary in the main curing of the ink. Furthermore, since the transport speed V [cm/s] of the medium is already known, if the irradiation time T [s] which is necessary in the main curing of the ink is divided by the transport speed V [cm/s] of the medium, it is possible to calculate the length [cm] in the transport direction of the light source which is necessary in the main curing of the ink.

Then, in the present embodiment, when the length in the transport direction of the yellow light source 81Y for strong pre-curing is set to L1, and the length in the transport direction of the light source 92 for main curing is set to L2, the length Lc in the transport direction of the light source which is necessary in the main curing of the color inks has a relationship of L1<Lc≤L1+L2.

Due to the relationship of L1<Lc, the color dots (in particular, the yellow dots which are formed last) do not undergo main curing in the stage where the ultraviolet light is irradiated from the yellow light source 81Y for strong pre-curing. For this reason, since the clear ink is coated before the color dots undergo main curing, the clear ink is suppressed from being repelled by the color dots.

On the other hand, due to the relationship of Lc≤L1+L2, the color dots are irradiated with ultraviolet light from the light source 92 for main curing to undergo main curing. For this reason, the printing is not completed in a state where the color dots do not undergo main curing.

In this embodiment, if the length in the transport direction of the light source which is necessary in the main curing of the color inks is set to Lc and the length in the transport direction of the light source which is necessary in the main curing of the clear ink is set to Lcl, the length L2 in the transport direction of the light source 92 for main curing has a relationship of Lcl<L2<Lc.

Due to the relationship of Lcl<L2, the clear dots are irradiated with ultraviolet light from the light source 92 for main curing to undergo main curing. For this reason, the printing is not completed in a state where the clear dots do not undergo main curing.

On the other hand, due to the relationship of L2<Lc, it is possible to configure the length of the light source 92 for main curing in the transport direction to be shorter. Here, since the color dots are irradiated with ultraviolet light from the yellow light source 81Y for strong pre-curing before the ultraviolet light is irradiated from the light source 92 for main curing, even with a relationship of L2<Lc, the color dots are irradiated with ultraviolet light from the light source 92 for main curing to undergo main curing.

UV Ink

Ink Composition

Below, description will be given of additives (components) which are included or are able to be included in the UV ink composition (below, simply referred to as the "ink composition") of the above-described embodiment.

In the following description, "(meth)acrylate" has the meaning of at least any one of acrylate and methacrylate which corresponds thereto and "(meth)acryl" has the meaning of at least any one of acryl and methacryl which corresponds thereto.

In the following description, "curable" refers to a property of polymer curing using the irradiation of light with or without the presence of a optical polymerization initiator. "Ejection stability" refers to a property of ejecting stable ink droplets from the nozzles normally without nozzle clogging.

Polymerizable Compound

The polymerizable compound which is included in the ink composition of the present embodiment is polymerized during the ultraviolet light irradiation by the action of the photopolymerization initiator to be described later, whereby it is possible to cure the printed ink.

Monomer A

The monomer A which is the essential polymerizable compound in the present embodiment is a vinyl ether group-containing (meth)acrylate ester type, and is represented by the following general formula (I).

$$CH^2{=}CR^1{-}COOR^2{-}O{-}CH{=}CH{-}R^3 \quad (I)$$

(In the formula, $R^1$ is a hydrogen atom or a methyl group, $R^2$ is a divalent organic residue with 2 to 20 carbon atoms, and $R^3$ is a hydrogen atom or a monovalent organic residue with 1 to 11 carbon atoms.)

It is possible to obtain a good curing property in the ink as a result of the monomer A being contained in the ink composition.

In the above-described general formula (I), as the divalent organic residue with 2 to 20 carbon atoms represented by $R^2$, a linear, branched or cyclic alkylene group with 2 to 20 carbon atoms, an alkylene group with 2 to 20 carbon atoms which has an oxygen atom using an ether bond and/or an ester bond in the structure, or a divalent aromatic group with 6 to 11 carbon atoms which may be substituted are preferable. Among the above, an alkylene group with 2 to 6 carbon atoms such as an ethylene group, an n-propylene group, isopropylene group, or a butylene group, or an alkylene group with 2 to 9 carbon atoms which has an oxygen atom using an ether bond in a structure such as an oxyethylene group, an oxy-n-propylene group, an oxyisopropylene group, or an oxybutylene group, is preferably used.

In the above-described general formula (I), as the monovalent organic residue with 1 to 11 carbon atoms represented by $R^3$, a linear, branched or cyclic alkyl group with 1 to 10 carbon atoms, or an aromatic group with 6 to 11 carbon atoms which may be substituted are preferable. Among the above, an alkyl group with 1 to 2 carbon atoms which is a methyl group or an ethyl group, or an aromatic group with 6 to 8 carbon atoms such as a phenyl group or a benzyl group is preferably used.

In the case of groups where the above-described organic residue may be substituted, the substituent groups may be divided into groups which include carbon atoms and groups which do not include carbon atoms. First, in a case where the above-described substituent group is a group which includes carbon atoms, the carbon atoms are counted in the number of carbon atoms of the organic residue. The groups which include carbon atoms are not limited to the following; however, examples thereof include a carboxyl group, an alkoxy group, or the like. Next, the groups which do not include carbon atoms are not limited to the following; however, examples thereof include a hydroxyl group, or a halo group.

The above-described monomer A is not limited to the following; however, examples thereof include (meth)acrylic acid 2-vinyloxy ethyl, (meth)acrylic acid 3-vinyloxy propyl, (meth)acrylic acid 1-methyl-2-vinyloxy ethyl, (meth)acrylic acid 2-vinyloxy propyl, (meth)acrylic acid 4-vinyloxy butyl, (meth)acrylic acid 1-methyl-3-vinyloxy propyl, (meth) acrylic acid 1-vinyloxy methyl propyl, (meth)acrylic acid 2-methyl-3-vinyloxy propyl, (meth)acrylic acid 1,1-dimethyl-2-vinyloxy ethyl, (meth)acrylic acid 3-vinyloxy butyl, (meth)acrylic acid 1-methyl-2-vinyloxy propyl, (meth) acrylic acid 2-vinyloxy butyl, (meth)acrylic acid 4-vinyloxy cyclo hexyl, (meth)acrylic acid 6-vinyloxy hexyl, (meth) acrylic acid 4-vinyloxy methyl cyclohexyl methyl, (meth) acrylic acid 3-vinyloxy methyl cyclo hexyl methyl, (meth) acrylic acid 2-vinyloxy methyl cyclo hexyl methyl, (meth) acrylic acid p-vinyloxy methyl phenyl methyl, (meth)acrylic acid m-vinyloxy methyl phenyl methyl, (meth)acrylic acid o-vinyloxy methyl phenyl methyl, (meth)acrylic acid 2-(vinyloxy ethoxy)ethyl, (meth)acrylic acid 2-(vinyloxy isopropoxy)ethyl, (meth)acrylic acid 2-(vinyloxy ethoxy) propyl, (meth)acrylic acid 2-(vinyloxy ethoxy) isopropyl, (meth) acrylic acid 2-(vinyloxy isopropoxy)propyl, (meth)acrylic acid 2-(vinyloxy isopropoxy)isopropyl, (meth)acrylic acid 2-(vinyloxy ethoxy ethoxy)ethyl, (meth)acrylic acid 2-(vinyloxy ethoxy isopropoxy)ethyl, (meth)acrylic acid 2-(vinyloxy isopropoxy ethoxy)ethyl, (meth)acrylic acid 2-(vinyloxy isopropoxy isopropoxy)ethyl, (meth)acrylic acid 2-(vinyloxy ethoxy ethoxy)propyl, (meth)acrylic acid 2-(vinyloxy ethoxy isopropoxy)propyl, (meth)acrylic acid 2-(vinyloxy isopropoxy ethoxy)propyl, (meth)acrylic acid 2-(vinyloxy isopropoxy isopropoxy)propyl, (meth)acrylic acid 2-(vinyloxy ethoxy ethoxy)isopropyl, (meth)acrylic acid 2-(vinyloxy ethoxy isopropoxy)isopropyl, (meth)acrylic acid 2-(vinyloxy isopropoxy ethoxy)isopropyl, (meth)acrylic acid 2-(vinyloxy isopropoxy isopropoxy)isopropyl, (meth)acrylic acid 2-(vinyloxy ethoxy ethoxy ethoxy)ethyl, (meth)acrylic acid 2-(vinyloxy ethoxy ethoxy ethoxy ethoxy)ethyl, (meth) acrylic acid 2-(isopropenoxy ethoxy)ethyl, (meth)acrylic acid 2-(isopropenoxy ethoxy ethoxy)ethyl, (meth)acrylic acid 2-(isopropenoxy ethoxy ethoxy ethoxy)ethyl, (meth) acrylic acid 2-(isopropenoxy ethoxy ethoxy ethoxy ethoxy) ethyl, (meth)acrylic acid polyethylene glycol monovinyl ether, and (meth)acrylic acid polypropylene glycol monovinyl ether.

Among the above, due to having a high flash point at low viscosity and excellent curability, (meth)acrylic acid 2-(vinyloxy ethoxy)ethyl, that is, at least any one of acrylate 2-(vinyloxy ethoxy)ethyl, methacrylate 2-(vinyloxy ethoxy)ethyl, is preferable, and acrylate 2-(vinyloxy ethoxy)ethyl is more preferable. Examples of the (meth)acrylic acid 2-(vinyloxy ethoxy)ethyl include (meth)acrylic acid 2-(2-vinyloxy ethoxy)ethyl and (meth)acrylic acid 2-(1-vinyloxy ethoxy) ethyl, and examples of the acrylate 2-(vinyloxy ethoxy)ethyl include acrylate 2-(2-vinyloxy ethoxy)ethyl (below referred to as "VEEA"), and acrylate 2-(1-vinyloxy ethoxy)ethyl.

The method of manufacturing the monomer A is not limited to the following; however, examples thereof include a method (method B) of esterifying the (meth)acrylic acid and a hydroxyl group-containing vinyl ether, a method (method C) of esterifying a (meth)acrylic acid halide and the hydroxyl group-containing vinyl ether, a method (method D) of esterifying a (meth)acrylic acid anhydride and the hydroxyl group-containing vinyl ether, a method (method E) of ester replacing a (meth)acrylic acid ester and the hydroxyl group-containing vinyl ether, a method (method F) of esterifying a (meth) acrylic acid and a halogen group-containing vinyl ether, a method (method G) of esterifying a (meth)acrylic acid alkali (earth) metal salt and a halogen group-containing vinyl ether, a method (method H) of vinyl replacing a hydroxyl group-containing (meth)acrylic acid ester and a vinyl carboxylic acid, and a method (method I) of ether replacing a hydroxyl group-containing (meth)acrylic acid ester and an alkyl vinyl ether.

Polymerizable Compounds Other than Monomer A

In addition, other than the above-described vinyl ether group-containing (meth)acrylic acid ester (monomer A), it is also possible to use various types of well-known monofunctional, bifunctional, or trifunctional or greater multifunctional monomers and oligomers (below, referred to "other polymerizable compounds"). Examples of the above-described monomers include unsaturated carboxylic acids such as (meth)acrylic acid, itaconic acid, crotonic acid, isocrotonic acid, maleic acid, and salts thereof, or esters, urethanes, amides and anhydrides thereof, acrylonitrile, styrene, various unsaturated polyesters, unsaturated polyethers, unsaturated polyamides, and unsaturated urethanes. In addition, examples of the above-described oligomers include oligomers which are formed from the above-described monomers such as linear acrylic oligomers, epoxy(meth)acrylate, oxetane(meth)acrylate, aliphatic urethane(meth)acrylate, aromatic urethane(meth)acrylate, and polyester(meth)acrylate.

In addition, the other monofunctional monomers and polyfunctional monomers may include N-vinyl compounds. Examples of the N-vinyl compounds include N-vinyl formamide, N-vinyl carbazole, N-vinyl acetamide, N-vinyl pyrrolidone, N-vinyl caprolactam, acryloyl morpholine, derivatives thereof, and the like.

Among the other polymerizable compounds, esters of (meth)acrylic acid, that is, (meth)acrylate are preferable.

Among the above-described (meth)acrylates, examples of monofunctional (meth)acrylates include isoamyl (meth)acrylate, stearyl (meth)acrylate, lauryl (meth)acrylate, octyl (meth)acrylate, decyl (meth)acrylate, isomyristyl (meth) acrylate, isostearyl (meth)acrylate, 2-ethyl hexyl-diglycol (meth)acrylate, 2-hydroxybutyl (meth)acrylate, butoxy ethyl (meth)acrylate, ethoxy-diethylene glycol (meth)acrylate, methoxy diethylene glycol (meth)acrylate, methoxy polyethylene glycol (meth)acrylate, methoxy propylene glycol (meth)acrylate, phenoxyethyl (meth)acrylate, tetrahydrofurfuryl (meth)acrylate, isobornyl (meth)acrylate, 2-hydroxyethyl (meth)acrylate, 2-hydroxypropyl (meth)acrylate, 4-hydroxybutyl (meth)acrylate, 2-hydroxy-3-phenoxypropyl (meth)acrylate, lactone-modified flexible (meth)acrylate, t-butyl cyclohexyl (meth)acrylate, dicyclopentanyl (meth) acrylate, and dicyclopentenyloxyethyl (meth)acrylate.

Among the above-described (meth)acrylates, examples of the bifunctional (meth)acrylates include triethylene glycol di(meth)acrylate, tetraethylene glycol di(meth)acrylate, polyethylene glycol di(meth)acrylate, dipropylene glycol di(meth)acrylate, tripropylene glycol di(meth)acrylate, polypropylene glycol di(meth)acrylate, 1,4-butanediol di(meth)acrylate, dicyclopentanyl di(meth)acrylate, 1,6-hexanediol di(meth)acrylate, 1,9-nonanediol di(meth)acrylate, neopentyl glycol di(meth)acrylate, dimethylol-tricyclodecane(meth)acrylate, EO (ethylene oxide) adduct di(meth) acrylate of bisphenol A, PO (propylene oxide) adduct di(meth)acrylate of bisphenol A, hydroxypivalic acid neopentyl glycol di(meth)acrylate, polytetramethylene glycol di(meth)acrylate, and an acrylated amine compound which is obtained by reacting a 1,6-hexanediol di(meth)acrylate and an amine compound. Here, examples of commercially available acrylated amine compounds which are obtained by reacting 1,6-hexane diol di(meth)acrylate and an amine compound include EBECRYL 7100 (a compound containing two amino groups and two acryloyl groups, manufactured by Cytech, Inc., product name) and the like.

Among the above-described (meth)acrylates, examples of the trifunctional or greater multifunctional (meth)acrylate include trimethylolpropane tri(meth)acrylate, EO-modified trimethylolpropane tri(meth)acrylate, pentaerythritol tri (meth)acrylate, isocyanuric acid EO-modified tri(meth)acrylate, pentaerythritol tetra(meth)acrylate, dipentaerythritol hexa(meth)acrylate, ditrimethylolpropane tetra(meth)acrylate, glycerin propoxy tri(meth)acrylate, caprolactone modified trimethylolpropane tri(meth)acrylate, pentaerythritol ethoxy tetra(meth)acrylate, and caprolactam modified dipentaerythritol hexa(meth)acrylate.

In addition, among the above, the other polymerizable compounds preferably include a monofunctional (meth)acrylate. In such a case, the ink composition has a low viscosity and excellent solubility with the photopolymerization initiator and other additives, and is able to easily obtain ejection stability. Furthermore, since the toughness of the ink coated film, the heat resistance, and the chemical resistance are increased, combining the monofunctional (meth)acrylate and the bifunctional (meth)acrylate is more preferable.

Furthermore, the above-described monofunctional (meth) acrylate preferably has one type or more of skeleton which is selected from a group consisting of an aromatic ring skeleton, a saturated alicyclic skeleton, and an unsaturated alicyclic skeleton. By the above-described other polymerizable compound being a monofunctional (meth)acrylate which has the above-described skeleton, it is possible to decrease the viscosity of the ink composition.

Examples of a monofunctional (meth)acrylate which has the aromatic ring skeleton include phenoxyethyl (meth)acrylate and 2-hydroxy-3-phenoxypropyl (meth)acrylate. In addition, examples of a monofunctional (meth)acrylate which has a saturated alicyclic skeleton include isobornyl (meth)acrylate, t-butyl cyclohexyl (meth)acrylate, and dicyclopentanyl (meth)acrylate. In addition, examples of a monofunctional (meth)acrylate which has an unsaturated alicyclic skeleton include dicyclopentenyloxyethyl (meth)acrylate.

Among the above, since it is possible to decrease the viscosity and odor, phenoxyethyl (meth)acrylate is preferable.

The content of the polymerizable compounds other than the monomer A is preferably 10 to 35 mass % with respect to the total amount (100 mass %) of the ink composition. When the content is within the above-described range, the solubility of the additives is excellent, and the toughness of the ink coating film, heat resistance, and the chemical resistance are excellent.

The above-described polymerizable compound may be used alone as one type or may be combined as two or more types.

Photopolymerization Initiator

The photopolymerization initiator which is included in the ink composition of the embodiment is used in order to form text by curing the ink which is present on the surface of the target recording medium using photopolymerization due to the irradiation of ultraviolet light. By using ultraviolet light (UV) as the radiation, the safety is excellent and it is possible to suppress the cost of the light source lamp.

As described above, the above-described photopolymerization initiator contains an acylphosphine based photopolymerization initiator and a thioxanthone based photopolymerization initiator. In this manner, in addition to it being possible to have excellent curability ink, it is possible to prevent initial coloration of the cured film after printing.

In addition thereto, as described above, the total content of the acylphosphine based photopolymerization initiator and a thioxanthone based photopolymerization initiator is 9 to 14 mass % with respect to the total amount (100 mass %) of the ink composition, preferably 10 to 13 mass %, and more preferably 11 to 13 mass %. In a case where the total content in the above inks is within the above-described range, the curability and the ejection stability of the ink are particularly excellent. In particular, when the content is 9 mass % or more, since the viscosity is comparatively high and it is possible to prevent an increase in mist which is a cause of contamination of the image, the ejection stability of the ink is excellent.

Acylphosphine Based Photopolymerization Initiator

The photopolymerization initiator in the present embodiment includes an acylphosphine based photopolymerization initiator, that is, an acylphosphine oxide based photopolymerization initiator (below, simply referred to as an "acylphosphine oxide"). In this manner, the curability of the ink is particularly excellent, and it is possible to prevent the initial coloration of the cured film after printing and the coloration over time of the cured film (the degree of initial coloration of the cured film is reduced).

The acylphosphine oxide is not particularly limited; however, examples thereof include 2,4,6-trimethyl benzoyl diphenyl phosphine oxide, 2,4,6-triethylbenzoyl diphenyl phosphine oxide, 2,4,6-triphenyl benzoyl diphenyl phosphine oxide, bis (2,4,6-trimethyl benzoyl)-phenyl phosphine oxide, and bis-(2,6-dimethoxy benzoyl)-2,4,4-trimethylpentyl phosphine oxide.

Examples of commercially available products of the acylphosphine oxide based photopolymerization initiator include DAROCUR TPO (2,4,6-trimethyl benzoyl-diphenylphosphine oxide), IRGACURE 819 (bis(2,4,6-trimethyl benzoyl)-phenyl phosphine oxide), and CGI 403 (bis-(2,6-dimethoxy benzoyl)-2,4,4-trimethylpentyl phosphine oxide).

In addition, the above-described acylphosphine oxide preferably includes monoacylphosphine oxide. In this manner, the photopolymerization initiator is sufficiently dissolved and the curing proceeds sufficiently, whereby the curability of the ink is excellent.

The monoacylphosphine oxide is not particularly limited; however, examples thereof include 2,4,6-trimethyl benzoyl diphenyl phosphine oxide, 2,4,6-triethylbenzoyl diphenyl phosphine oxide, and 2,4,6-triphenyl benzoyl-diphenylphosphine oxide. Among the above, 2,4,6-trimethyl benzoyl diphenyl phosphine oxide is preferable.

Examples of commercially available products of monoacylphosphine oxide include DAROCUR TPO (2,4,6 trimethyl benzoyl diphenyl phosphine oxide).

The photopolymerization initiator in the present embodiment is preferably a monoacylphosphine oxide or a compound of a monoacylphosphine oxide and a bisacylphosphine oxide as the solubility with the polymerizable compound and the curability of the inner portion of the ink cured film are excellent and the degree of initial coloration is reduced.

Here, the above-described bisacylphosphine oxide is not particularly limited; however, examples thereof include bis(2,4,6-trimethyl benzoyl)-phenyl phosphine oxide, and bis-(2,6-dimethoxybenzoyl)-2,4,4-trimethylpentyl phosphine oxide. Among the above, bis(2,4,6-trimethyl benzoyl)-phenyl phosphine oxide is preferable.

The content of the acylphosphine oxide is preferably in a range of 8 to 11 mass % with respect to the total amount (100 mass %) of the ink composition, and more preferably in a range of 10 to 11 mass %. When the content is within the above-described range, the curability of the ink is excellent and the degree of initial coloration of the curing film is small.

Thioxanthone Based Photopolymerization Initiator

The photopolymerization initiator in the present embodiment includes a thioxanthone based photopolymerization initiator (below, simply referred to as "thioxanthone"). In this manner, the curability of the ink is excellent and the degree of initial coloration of the curing film is particularly small.

Among the thioxanthones, 2,4-diethyl thioxanthone is preferable since the sensitizing effect on acylphosphine oxide, the solubility with respect to the polymerizable compound, and the safety are excellent.

Examples of commercially available products of thioxanthone include KAYACURE DETX-S (2,4-diethyl thioxanthone) (manufactured by Nippon Kayaku Co., Ltd., product name), ITX (manufactured by BASF), and Quantacure CTX (manufactured by Aceto Chemical Industries).

The content of the thioxanthone is preferably in a range of 1 to 3 mass % with respect to the total amount (100 mass %) of the ink composition, more preferably a range of 2 to 3 mass %. When the content is within the above-described range, the curability of the ink is excellent and the degree of initial coloration of the curing film is reduced.

Coloring Material

The ink composition of the present embodiment may further include a coloring material. It is possible to use at least one of a pigment or a dye as the coloring material.

Pigment

In the present embodiment, it is possible to improve the light fastness of the ink composition by using a pigment as the coloring material. It is possible to use either a non-organic pigment or an organic pigment as the pigment.

As the inorganic pigments, it is possible to use types of carbon black (C. I. Pigment Black 7) such as furnace black, lamp black, acetylene black, and channel black, iron oxide, and titanium oxide.

Examples of organic pigments include insoluble azo pigments, condensed azo pigments, azo lake, azo pigments such as chelate azo pigments, phthalocyanine pigments, perylene and perinone pigments, anthraquinone pigments, quinacridone pigments, dioxane pigments, thioindigo pigments, isoindolinone pigments, polycyclic pigments such as quinophthalone pigments, dye chelates (for example, basic dye type chelates, acidic dye type chelates, or the like), dye lakes (basic dye type lakes, acidic dye type lakes), nitro pigments, nitroso pigments, aniline black, and daylight fluorescent pigments.

More specifically, examples of the carbon black which is used as the black ink include No. 2300, No. 900, MCF88, No. 33, No. 40, No. 45, No. 52, MA7, MA8, MA100, No. 2200B, (the above are product names manufactured by Mitsubishi Chemical Corporation), Raven 5750, Raven 5250, Raven 5000, Raven 3500, Raven 1255, Raven 700, or the like (the above are product names manufactured by Carbon Columbia), Regal 400R, Regal 330R, Regal 660R, Mogul L, Monarch 700, Monarch 800, Monarch 880, Monarch 900, Monarch 1000, Monarch 1100, Monarch 1300, Monarch 1400, and the like (product names manufactured by Cabot Japan K.K.), Color Black FW1, Color Black FW2, Color Black FW2V, Color Black FW18, Color Black FW200, Color Black S150, Color Black S160, Color Black S170, Printex 35, Printex U, Printex V, Printex 140U, Special Black 6, Special Black 5, Special Black 4A, Special Black 4, and the like (the above are product names manufactured by Degussa).

Examples of the pigment used in the white ink include C. I. Pigment White 6, 18, and 21. In addition, it is also possible to use a metal atom containing compound which is able to be used as a white pigment, examples of which include metal oxides which have been used in the past as white pigments, barium sulfate and calcium carbonate. The above-described metal oxides are not particularly limited; however, examples thereof include titanium dioxide, zinc oxide, silica, alumina, magnesium oxide, and the like.

Examples of the pigment which is used in the yellow ink include C. I. Pigment Yellow 1, 2, 3, 4, 5, 6, 7, 10, 11, 12, 13, 14, 16, 17, 24, 34, 35, 37, 53, 55, 65, 73, 74, 75, 81, 83, 93, 94, 95, 97, 98, 99, 108, 109, 110, 113, 114, 117, 120, 124, 128, 129, 133, 138, 139, 147, 151, 153, 154, 155, 167, 172, and 180.

Examples of the pigment which is used in the magenta ink include C. I. Pigment Red 1, 2, 3, 4, 5, 6, 7, 8, 9, 10, 11, 12, 14, 15, 16, 17, 18, 19, 21, 22, 23, 30, 31, 32, 37, 38, 40, 41, 42, 48 (Ca), 48 (Mn), 57 (Ca), 57:1, 88, 112, 114, 122, 123, 144, 146, 149, 150, 166, 168, 170, 171, 175, 176, 177, 178, 179, 184, 185, 187, 202, 209, 219, 224, 245, or C. I. Pigment Violet 19, 23, 32, 33, 36, 38, 43, and 50.

Examples of the pigment which is used in the cyan ink include C. I. Pigment Blue 1, 2, 3, 15, 15:1, 15:2, 15:3, 15:34, 15:4, 16, 18, 22, 25, 60, 65, 66, or C. I. Vat Blue 4, and 60.

In addition, examples of the pigments other than the magenta, cyan, and yellow include C. I. Pigment Green 7, 10, C. I. Pigment Brown 3, 5, 25, 26, C. I. Pigment Orange 1, 2, 5, 7, 13, 14, 15, 16, 24, 34, 36, 38, 40, 43, and 63.

The above-described pigments may be used alone as one type or may be combined as two or more types.

In a case where the above-described pigments are used, the average particle diameter thereof is preferably 2 μm or less and more preferably 30 to 300 nm. When the average particle diameter is within the above-described range, the reliability of the ejection stability, dispersion stability, and the like in the ink composition are superior, and it is possible to form an image with excellent image quality. Here, the average particle diameter in the present specification is measured using a dynamic light scattering method.

Dye

In the present embodiment, it is possible to use a dye as the coloring material. The dyes are not particularly limited; however, it is possible to use acidic dyes, direct dyes, reactive dyes, and basic dyes. Examples of the dyes include C. I. Acid Yellow 17, 23, 42, 44, 79, 142, C. I. Acid Red 52, 80, 82, 249, 254, 289, C. I. Acid Blue 9, 45, 249, C. I. Acid Black 1, 2, 24, 94, C. I. Food Black 1, 2, C. I. Direct Yellow 1, 12, 24, 33, 50, 55, 58, 86, 132, 142, 144, 173, C. I. Direct Red 1, 4, 9, 80, 81, 225, 227, C. I. Direct Blue 1, 2, 15, 71, 86, 87, 98, 165, 199, 202, C. I. Direct Black 19, 38, 51, 71, 154, 168, 171, 195, C. I. Reactive Red 14, 32, 55, 79, 249, C. I. Reactive Black 3, 4, and 35.

The above-described dyes may be used alone as one type or may be combined as two or more types.

Since the content of the coloring material has a good color development property and it is possible to reduce curing inhibition of the ink coated film using the light absorption of the coloring material itself, the content is preferably in a range of 1.5 to 6 mass % in the case of CMYK and preferably in a range of 15 to 30 mass % in the case of W with respect to total amount (100 mass %) of the ink composition.

Dispersant

In a case where the ink composition of the present embodiment includes a pigment, in order to improve the pigment dispersibility, a dispersant may be further included. The dispersant is not particularly limited; however, examples thereof include dispersants customarily used to prepare pigment dispersions such as a polymer dispersant. Specific examples thereof include those in which the main component is one type or more from among polyoxyalkylene polyalkylene polyamine, vinyl based polymers and copolymers, acrylic based polymers and copolymers, polyester, polyamide, polyimide, polyurethane, amine based polymers, silicon-containing polymers, sulfur-containing polymers, fluorine-containing polymers, and epoxy resin.

Examples of commercially available polymer dispersants include the Aji Spa series manufactured by Ajinomoto Fine-Techno Co., Inc. (product name), the Solsperse series available from Lubrizol Corporation (Solsperse 36000 and the like, product name), the Disperbyk series manufactured by BYK Chemie (product name), and the Disparlon series (product name) manufactured by Kusumoto Chemicals.

Leveling Agent

The ink composition of the present embodiment may further include a leveling agent (surfactant) in order to improve the wettability to the printing substrate. The leveling agent is not particularly limited; however, it is possible to use a polyester-modified silicone or polyether-modified silicone as a silicone-based surfactant, and the use of a polyester-modified polydimethylsiloxane or a polyether-modified polydimethylsiloxane is particularly preferable. Specific examples thereof include BYK-347, BYK-348, BYK-UV3500, 3510, 3530, and 3570 (product names manufactured by BYK Japan K.K.).

Polymerization Inhibitor

The ink composition of the present embodiment may further include a polymerization inhibitor in order to improve the storage stability of the ink composition. The polymerization inhibitor is not particularly limited; however, it is possible to use IRGASTAB UV10 and UV22 (manufactured by BASF, product name), or hydroquinone monomethyl ether (MEHQ, manufactured by Kanto Chemical Co., Inc., product name).

Other Additives

The ink composition of the present embodiment may include additives (components) other than the additives given above. Such components are not particularly limited; however, well-known polymerization accelerators, penetration enhancers, wetting agents (moisturizers), and other additives are possible. Examples of the above-described other additives include well-known fixing agents, fungicides, preservatives, antioxidants, ultraviolet light absorbing agents, chelating agents, pH adjusting agents, and thickeners.

Physical Properties of Ink Composition

The ink composition of the present embodiment preferably has a viscosity of 15 mPa·s or less at 20° C., more preferably 9 to 14 mPa·s. When the viscosity is within the above-described range, the solubility with the photopolymerization initiator and other additives is excellent, and ejection stability is able to be easily obtained. Here, the viscosity in the present specification is a value which is measured using a rheometer MCR300 manufactured by DKSH Japan Inc.

In addition, it is preferable that the ink composition of the present embodiment be curable using the irradiation of ultraviolet light of which the light emission peak wavelength is in the range of 365 to 405 nm.

Specific Examples

Use Components

The components which are used in the UV ink are as follows.

Pigment

- FASTOGEN BLUE (color index name: Pigment Blue 15:4, product name, manufactured by DIC, abbreviated as cyan in FIG. 13A.)
- CROMOPHTAL PinkPT (SA) GLVO (color index name: C. I. Pigment Red 122, product name, manufactured by BASF, abbreviated as magenta in FIG. 13A.)
- Color index name: C. I. Pigment Yellow 180, (manufactured by DIC, product name: SYMULER FAST YELLOW, abbreviated as yellow 1 in FIG. 13A.)
- Color Index name: C. I. Pigment Yellow 150, (abbreviated as yellow 2 in FIG. 13A.)
- Color Index name: C. I. Pigment Yellow 155, (abbreviated as yellow 3 in FIG. 13A.)
- Color Index name: C. I. Pigment Yellow 74, (abbreviated as yellow 4 in FIG. 13A.)
- MICROLITH-WA Black C-WA (color index name: C. I. Pigment Black 7, product name, manufactured by BASF, abbreviated as black in FIG. 13A.)
- Pigment White 06 (titanium dioxide, product name, manufactured by Mikuni Color Ltd., abbreviated as white in FIG. 13A.)

Dispersant

- SOLSPERSE 36000 (amine based, manufactured by Lubrizol Corporation, product name, abbreviated as amine based dispersant A in FIG. 13A.)

Polymerizable Compound

- VEEA (acrylic acid 2-(2-vinyloxyethoxy)ethyl, manufactured by Nippon Shokubai Co., Ltd., product name, abbreviated as VEEA in FIG. 13A.)
- 3-oxa-5-hexene-1-ol, abbreviated as EGME in FIG. 13A.
- Viscoat #192 (phenoxyethyl acrylate, manufactured by Osaka Organic Chemical Co. Ltd., product name, abbreviated as PEA in FIG. 13A.)
- 4-HBA (4-hydroxybutyl acrylate, manufactured by Osaka Organic Chemical Co. Ltd., product name, abbreviated as 4-HBA in FIG. 13A.)
- KAYARAD R-684 (tricyclodecane dimethylol diacrylate, manufactured by Nippon Kayaku Co., Ltd., product name, abbreviated as R-684 in FIG. 13A.)
- A-DPH (dipentaerythritol hexaacrylate, manufactured by Shin-Nakamura Chemical Co., Ltd., product name, abbreviated as A-DPH in FIG. 13A.)
- NK Ester A-9300 (ethoxylated isocyanurate triacrylate, manufactured by Shin-Nakamura Chemical Co., Ltd., product name, abbreviated as A-9300 in FIG. 13A.)

Polymerization Inhibitor

- MEHQ (manufactured by Kanto Chemical Co., Inc., product name, abbreviated as MEHQ in FIG. 13A.)

Leveling Agent

Silicone-based surface adjusting agent BYK-UV3500 (manufactured by BYK, product name, abbreviated as UV3500 in FIG. 13A.)

Photopolymerization Initiator

IRGACURE 819 (manufactured by BASF, product name, abbreviated as 819 in FIG. 13A.)

DAROCUR TPO (manufactured by BASF, product name, abbreviated as TPO in FIG. 13A.)

KAYACURE DETX-S (manufactured by Nippon Kayaku Co., Ltd., product name, abbreviated as DETX-S in FIG. 13A.)

First, a pigment dispersion is prepared by mixing the pigments and dispersants described in FIG. 13A and PEA to form the compositions described in FIG. 13A (units: mass %). Next, the other components described in FIG. 13A are added to the prepared pigment dispersion to form the compositions described in FIG. 13A (units: mass %) and UV inks of each color (cyan C, magenta M, yellow Y, black K, white W, and clear CL) are obtained by stirring the above with a high-speed water-cooled stirrer. Here, in FIG. 13A, the blank sections have the meaning that nothing is added. In addition, the ink sets 1 to 17 are obtained by combining each of the color inks shown in the following table of FIG. 13B.

Sample Evaluation Test

Wrinkle Evaluation Method

Using each of the ink sets 1 to 17 in the printing apparatus of the first to fifth embodiments and the comparative example, color patches in which the yellow ink is shaken in 10% increments from a duty of 10% to 100% are each printed on the target recording surface of the optical recording medium. The printed state (presence or absence of wrinkles) of each color patch of the printed matter manufactured in this manner was observed visually under an environment with a room temperature of 23° C. and a humidity of 50% RH, and evaluation was performed according to the following evaluation criteria.

Evaluation Criteria

A: It is not possible to confirm the generation of wrinkles in the color patches of any of the duties from 10% to 100%

B: It is possible to confirm the generation of wrinkles in the color patches with a duty of 70% or more; however, it is not possible to confirm the generation of a bronzing phenomenon in the color patches with a duty of 60% or less.

C: It is possible to confirm the generation of wrinkles in the color patches of all the duties from 10% to 100%.

FIG. 14 is a table which shows the results of evaluating the wrinkles.

Method of Evaluating Surface Gloss

Using each of the ink sets 1 to 17 in the printing apparatus of the first to fifth embodiments and the comparative example, color patches in which the magenta ink, the cyan ink, the yellow ink, and the black ink are shaken in 10% increments from a duty of 10% to 100% are each printed on the target recording surface of the optical recording medium. Under an environment with a room temperature of 23° C. and a humidity of 50% RH, the degree of gloss of each color patch was measured using a variable angle gloss meter GM-3D type (manufactured by Murakami Color Research Laboratory) based on JIS-P8142, and the degree of gloss of the target recording surface of the optical recording medium was 60 degrees. The higher the measurement value (a degree of gloss of 60 degrees), the better the surface glossiness (influence of wrinkles is small).

With the same duty, the absolute value $|\Delta R|$ of the difference between the average value of the degree of gloss of the cyan ink, magenta ink, and black ink, and the degree of gloss of the yellow ink was calculated, and evaluation was performed according to the following evaluation criteria.

Evaluation Criteria

A: In all of the color patches with duties of 10% to 100%, $|\Delta R|$=less than 1.

B: The color patches with a duty of 70% or more, $|\Delta R|$=1 or more to less than 5. The color patches with a duty of 60% or less, $|\Delta R|$=less than 1.

C: In all of the color patches with duties of 10% to 100%, $|\Delta R|$=1 or more to less than 5.

D: In all of the color patches with duties of 10% to 100%, $|\Delta R|$=5 or more.

FIG. 15 is a table which shows the results of evaluating the surface glossiness.

Sensory Evaluation of Printed Matter

Using each of the ink sets 1 to 17 in the printing apparatus of the first to fifth embodiments and the comparative example, a medium formed of PET was set, and high-definition color digital standard image data of ISO12640: Appendix A were printed. The printed surface of the printed matter manufactured in this manner. 100 people selected at random were asked if the image quality was good or not. The evaluation environment is an office environment in which a 3 wavelength type daylight white fluorescent light is attached to the ceiling. After two printed images were lined up at the same time on an office desk and observed visually, judgement was performed with ones in which no bleeding (phenomenon in which colors bleed and mix in a non-uniform manner at the boundary portions of different colors) was visible being given 10 points (good image quality), ones in which bleeding was slightly visible being given 5 points, and ones in which bleeding was obvious being given 0 points.

Evaluation Criteria:

A: 800 points or more

B: less than 800 to 500 points or more

C: 500 points or less

FIG. 16 is a table which shows the results of sensory evaluation.

Other

The above-described embodiments are to facilitate understanding of the invention but are not to be construed as limiting the invention. It is possible to modify and improve the invention without departing from the spirit thereof and it is needless to say that the invention also includes equivalents thereof.

What is claimed is:

1. A printing apparatus comprising:

a transport unit configured to transport a medium in a transport direction;

a first head configured to eject black ink onto the medium;

a first light source which is provided further to a downstream side in the transport direction than the first head, the first light source being configured to irradiate a first light;

a second head which is provided further to the downstream side in the transport direction than the first head and the first light source, the second head being configured to eject yellow ink onto the medium;

a second light source which is provided further to the downstream side in the transport direction than the second head and which is configured to irradiate a second light with a stronger irradiation energy than the irradiation energy of the first light source;

a third light source which is provided further to an upstream side in the transport direction than the first head; and a third head which is provided further to the upstream side in the transport direction than the third light source, the third head being configured to eject the magenta ink or the cyan ink onto the medium, the first light source and the second light source having the same type of light source, an irradiation intensity of the second light irradiated by the second light source being equal to an irradiation intensity of the first light irradiated by the first light source while an irradiation time when the second light source irradiates the second light is longer than an irradiation time when the first light source irradiates the first light.

2. The printing apparatus according to claim 1, wherein the printing apparatus is provided with a printing apparatus ink set, the printing apparatus ink set has the magenta ink, the cyan ink, the yellow ink and the black ink, the magenta ink, the cyan ink, the yellow ink and the black ink contain a pigment, a polymerizable compound, and a photopolymerization initiator, and the polymerizable compound includes one type or two or more types which are selected from a group consisting of acrylate 2-(2-vinyloxyethoxy) ethyl, 3-oxa-5-hexene-1-ol, phenoxyethyl acrylate, 4-hydroxybutyl acrylate, tricyclodecane dimethylol diacrylate, dipentaerythritol hexaacrylate, and ethoxylated isocyanurate triacrylate.

3. The printing apparatus according to claim 1, wherein the yellow ink contains a pigment, a polymerizable compound, and a photopolymerization initiator, the polymerizable compound includes one type or two or more types which are selected from a group consisting of acrylate 2-(2-vinyloxyethoxy) ethyl, 3-oxa-5-hexene-1-ol, phenoxyethyl acrylate, 4-hydroxybutyl acrylate, tricyclodecane dimethylol diacrylate, dipentaerythritol hexaacrylate, and ethoxylated isocyanurate triacrylate, and the pigment is one type or two or more types which are selected from a group consisting of C. I. Pigment Yellow 150, 155, and 180.

4. The printing apparatus according to claim 1, wherein the third light source is configured to irradiate a third light with a weaker irradiation energy than the irradiation energy of the second light source.

5. The printing apparatus according to claim 1, wherein the second light source is a main curing light source.

6. The printing apparatus according to claim 1, further comprising:

a fourth head which is arranged further to the downstream side in the transport direction than the second light source and which ejects clear ink, which is cured by irradiation of light, onto the medium; and a fourth light source which is arranged further to the downstream side in the transport direction than the fourth head, wherein the fourth light source irradiates light with a stronger irradiation energy than the irradiation energy of the second light source.

7. The printing apparatus according to claim 1, further comprising:

a fifth head which is arranged further to the downstream side in the transport direction than the second light source and which ejects background ink, which is cured by irradiation of light.

8. The printing apparatus according to claim 1, further comprising:

a sixth head which ejects a yellow ink with a higher light transmittance than the yellow ink; and a sixth light source which is provided further to the downstream side in the transport direction than the sixth head and which irradiates light with a stronger irradiation energy than the irradiation energy of the first light source, wherein the second yellow ink is coated on a medium which is a transparent medium and a pale yellow image which has optical transparency is formed.

9. The printing apparatus according to claim 1, wherein a length of the second light source in the transport direction is greater than a length of the first light source in the transport direction.

10. The printing apparatus according to claim 1, wherein the same type of the light source is a light emitting diode.

* * * * *